US008733378B2

(12) United States Patent
Tayebi

(10) Patent No.: US 8,733,378 B2
(45) Date of Patent: May 27, 2014

(54) UMBRELLA MECHANISM AND METHODS OF USE

(76) Inventor: Sean K. Tayebi, La Jolla, CA (US)

( * ) Notice: Subject to any disclaimer, the term of this patent is extended or adjusted under 35 U.S.C. 154(b) by 0 days.

(21) Appl. No.: 13/427,801

(22) Filed: Mar. 22, 2012

(65) Prior Publication Data

US 2013/0092206 A1 Apr. 18, 2013

Related U.S. Application Data

(63) Continuation-in-part of application No. 13/272,094, filed on Oct. 12, 2011.

(51) Int. Cl.
*A45B 3/00* (2006.01)
*A45F 3/04* (2006.01)

(52) U.S. Cl.
USPC ..... 135/16; 135/20.3; 135/25.41; 135/34.2; 224/153; 224/186; 224/576

(58) Field of Classification Search
USPC ..... 135/16, 20.3, 25.1, 25.31, 25.32, 31, 135/910, 25.4–25.41, 34.2, 20.1; 362/102; 224/186, 190, 153, 158, 160, 575–576, 224/915
See application file for complete search history.

(56) References Cited

U.S. PATENT DOCUMENTS

| | | | | | |
|---|---|---|---|---|---|
| 1,781,479 | A * | 11/1930 | Schwartz | 135/25.2 |
| 2,725,066 | A * | 11/1955 | Estes et al. | 135/15.1 |
| 3,779,260 | A * | 12/1973 | Garay | 135/25.33 |
| 4,007,752 | A * | 2/1977 | Weber | 135/25.31 |
| 4,543,971 | A * | 10/1985 | Sirota | 135/16 |
| 5,349,975 | A * | 9/1994 | Valdner | 135/16 |
| 5,615,697 | A * | 4/1997 | Lin et al. | 135/20.1 |
| 6,024,464 | A * | 2/2000 | De Vera | 362/102 |
| 6,095,171 | A * | 8/2000 | Lin et al. | 135/33.7 |
| 6,612,320 | B2 * | 9/2003 | Lin et al. | 135/33.41 |
| 7,069,939 | B1 * | 7/2006 | Conde | 135/16 |
| 7,448,399 | B2 * | 11/2008 | Song et al. | 135/33.7 |
| 2004/0211451 | A1 * | 10/2004 | Goh | 135/31 |
| 2006/0283489 | A1 * | 12/2006 | Ho | 135/20.1 |
| 2007/0039638 | A1 * | 2/2007 | Johnson et al. | 135/16 |
| 2008/0006313 | A1 * | 1/2008 | Wang | 135/31 |
| 2008/0163907 | A1 * | 7/2008 | Garner | 135/15.1 |
| 2011/0132417 | A1 * | 6/2011 | Lee | 135/20.3 |

FOREIGN PATENT DOCUMENTS

| | | | | |
|---|---|---|---|---|
| GB | 2346556 | A * | 8/2000 | A45B 25/24 |
| JP | 04279105 | A * | 10/1992 | A45B 19/10 |
| JP | 08056725 | A * | 3/1996 | A45B 19/00 |

* cited by examiner

*Primary Examiner* — Winnie Yip
(74) *Attorney, Agent, or Firm* — Barry Choobin; Patent 360 LLC

(57) ABSTRACT

Apparatus and methods for an umbrella mechanism with an outer and inner shaft, a plurality of ribs connected with the outer shaft and a canopy supported by the plurality of ribs are provided. The plurality of ribs are configured into a substantially "V" shape when the umbrella mechanism is in a closed position, such that upon opening the umbrella into an open position, the plurality of ribs opens vertically before expanding horizontally, thus avoiding inadvertent contact of the umbrella with a user during the opening operation. The umbrella mechanism may be handheld or mounted to a structure such as a backpack, chair, table, patio or house, and may be operated by an enclosed motor. The motor may be powered by a battery, solar panel embedded into the canopy or an outside power source.

10 Claims, 41 Drawing Sheets

260

300

UMBRELLA MECHANISM AND METHODS OF USE

CROSS-REFERENCE TO RELATED APPLICATIONS

This application is a Continuation-in-Part of U.S. application Ser. No. 13/272,094, filed Oct. 12, 2011, now pending, the contents of which are incorporated by reference herein in their entirety.

BACKGROUND

1. Technical Field

The present disclosure generally relates to umbrella mechanisms, in particular to an umbrella mechanism that contains an umbrella within it which can unfold out automatically or mechanically while minimizing the potential for inadvertent contact with a user.

2. Description of the Related Art

Usually, users must operate an umbrella by holding on to the handle of the umbrella and either expanding it out by pressing a button or sliding a component. This may be cumbersome if the user has his or her hands tied and often requires the user to stop somewhere in order to get the umbrella to open. Likewise for umbrellas that come with tables or chairs designed for outdoor use. In addition, umbrellas are generally configured with supporting ribs in an "A" or "M" shape, such that upon opening the umbrella, the supporting ribs immediately extend the canopy of the umbrella outward from a central support shaft, thus risking hitting the user if the user is too close to the umbrella during the opening procedures.

Thus, there is a need for an umbrella mechanism which minimizes the effort required by the user to operate the umbrella and which avoids opening into the user.

SUMMARY

Apparatus and methods are provided for an umbrella mechanism with an outer and inner shaft, a plurality of ribs connected with the outer shaft and a canopy supported by the plurality of ribs. The plurality of ribs are configured into a substantially "V" shape when the umbrella mechanism is in a closed position, such that upon opening the umbrella into an open position, the plurality of ribs opens vertically before expanding horizontally, thus avoiding inadvertent contact of the umbrella with a user during the opening operation. The umbrella mechanism may be handheld or mounted to a structure such as a backpack, table, patio or house, and may be operated by an enclosed motor.

The handheld umbrella mechanism may be made into a unit that can be mounted on backpacks, clothing, chairs, tables, sides of houses, boats, cargo, and may also be equipped with a fan, heater, lights, decorations and other components. The umbrella mechanism may operate by one or more or a combination of a motor, springs, magnets, air or vacuum pressure (pneumatics), and be powered by a battery, electrical power source, solar power or any other source of power generation effective to operate the umbrella mechanism.

Provided is a handheld umbrella mechanism, which includes a handheld housing, a raise motor, an outer tube, an inner tube and a power unit; and a canopy unit comprising at least one rib leg, an inner shaft, and an outer shaft slider, the at least one rib leg connected to a canopy and also connected to the outer shaft slider, and wherein the outer shaft slider is able to slide up and down the inner shaft in order to fully extend and contract the canopy, the outer shaft slider being controlled by the raise motor.

Also provided is a method for using a handheld umbrella mechanism, including: activating a raise motor in order to raise and fully expand an umbrella canopy from a handheld housing of the handheld umbrella mechanism; performing operations with the umbrella canopy fully extended over a subject; and activating the raise motor again in order to contract the umbrella canopy back into the handheld housing.

Also provided is a handheld umbrella mechanism, including: a handheld housing connected with an inner shaft; an outer shaft slidably attached with the inner shaft; a canopy unit comprising at least one rib leg, the at least one rib leg connected to a canopy and also connected with the outer shaft, wherein the outer shaft slides up and down the inner shaft in order to fully extend and contract the canopy; the outer shaft slider being controlled by a spring mechanism which expands to extend the canopy and contracts to contract the canopy.

BRIEF DESCRIPTION OF THE DRAWINGS

The embodiments are illustrated by way of example and not limitation in the figures of the accompanying drawings in which like references indicate like elements.

DETAILED DESCRIPTION

Figure 1A:
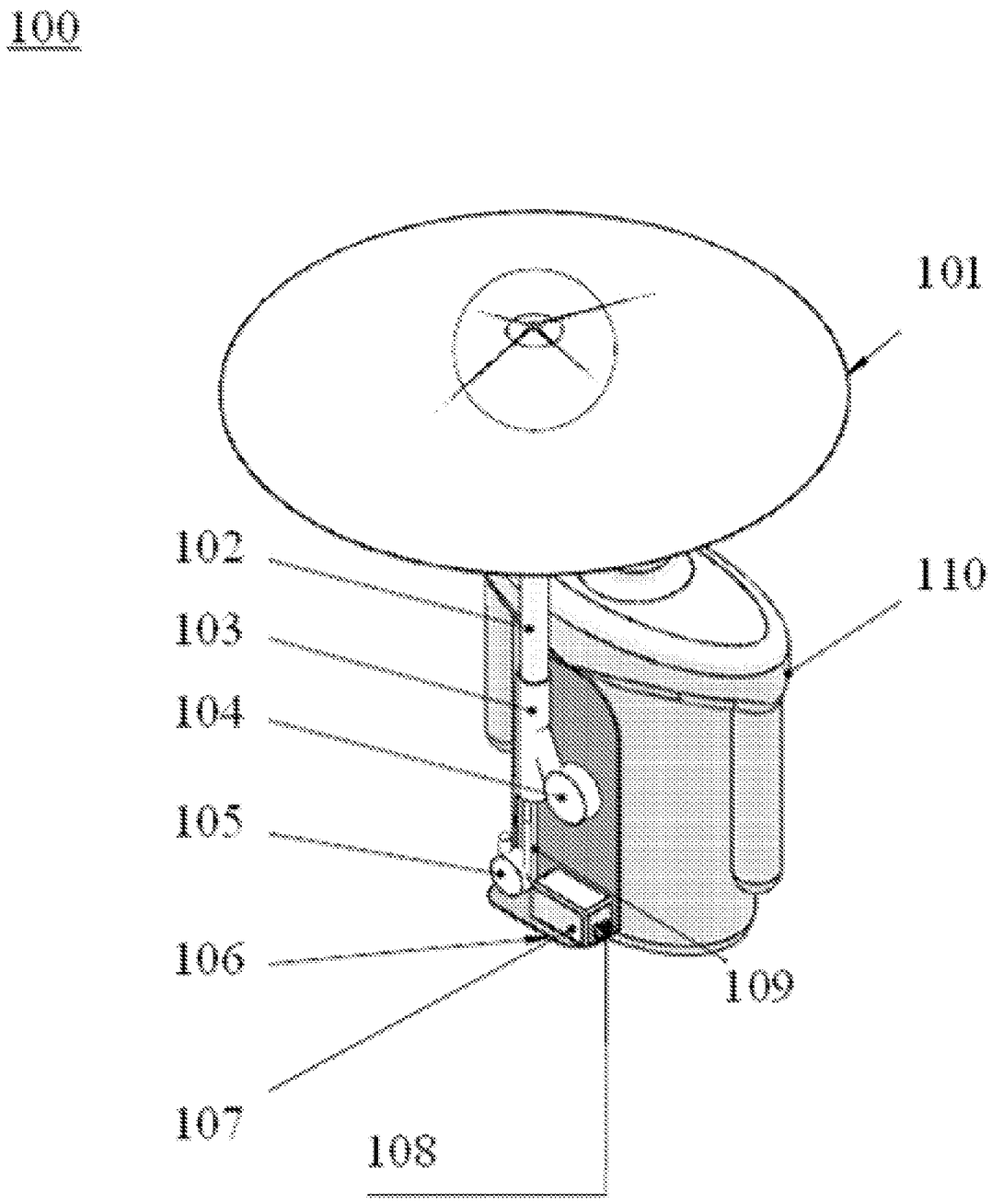
FIG. 1A illustrates an aerial rear view shot of the umbrella backpack mechanism in accordance with an embodiment of the present disclosure.

The following description and drawings are illustrative and are not to be construed as limiting. Numerous specific details are described to provide a thorough understanding. However, in certain instances, well known or conventional details are not described in order to avoid obscuring the description. References to one or an embodiment in the present disclosure are not necessarily references to the same embodiment, and such references mean at least one.

The use of headings herein is merely provided for ease of reference and shall not be interpreted in any way to limit this disclosure or the following claims.

Reference in this specification to "one embodiment" or "an embodiment" or the like means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described that may be exhibited by some embodiments and not by others. Similarly, various requirements are described that may be requirements for some embodiments but not other embodiments.

The present disclosure relates to systems and methods for an umbrella backpack mechanism are provided that allow an umbrella to expand automatically and mechanically without the user having to operate the handle of the umbrella. The backpack can be worn on the back of a user. Furthermore, the backpack may be made into a unit that can be mounted on chairs, tables, sides of houses, boats (e.g. fishing boats for fishing expeditions, or large Navy boats), cargo ships, cargo, temporary work stations, outposts, and may also be equipped with a fan, heater, lights, decorations and other components. In one embodiment, the umbrella can also be multiple sizes, and can range from a small to a large umbrella. In one embodiment, the umbrella can also be titled in different directions and oriented in different angles. In one embodiment, the umbrella may be pushed down into a tube, and the tube can be made from a material including fabric, plastic, metal and other such materials. In one embodiment, the backpack unit may be powered by batteries/chargers or be hooked into an electric current or power source.

Users—which range from children to adults—can use the umbrella backpack mechanism by wearing it on their back and traveling in rain, snow, sun and hot or humid climate. It may also be used during exercise or outdoor activities such as walking, running, hiking, biking, golfing, or any other outdoor sport. Basically, the umbrella backpack mechanism allows the user to use both hands while an umbrella also is extended to protect them from rain, hail or snow. For instance, the hands of the user can be instead used to carry and operate a phone (e.g., to send text messages and make calls, operations that would normally require the use of two hands). Also, entering structures or vehicles such as cars, taxis, buses or trains would be made extremely convenient without having to collapse the umbrella, make a mess, and re-extend it. The umbrella would be able to conveniently and quickly re-collapse back into the backpack without making a mess with a simple user action—such as, for example, a press of a button. Furthermore, another frequent nuisance of umbrella usage is leaving one's umbrella somewhere and losing it or having it stolen. By having the umbrella integrated with a backpack unit, the umbrella will constantly be with the user at all times. In one embodiment, the umbrella may be quipped with heaters (to use in very cold environments), cooling units such as fans (to use in very hot environments) lights, decorations, or other components. For instance, children or other uses can decorate the backpack with decorations or trendy components that also may add functionality as well as an aesthetic appeal. Additional technical components such as GPS units, computers, phones, and so on may also be integrated into the backpack, to be used in case the backpack or user gets lost somewhere.

FIG. 1A illustrates an aerial rear view shot of the umbrella backpack mechanism in accordance with an embodiment of the present disclosure. Umbrella backpack mechanism 100 includes canopy 101, inner tube 102, outer tube 103, fan 104, raise motor 105, rucksack base 106, battery box 107, buttons and switches 108, drain tube 109 and body 110. Canopy 101 may be made from any material that is usually used for the canopy of an umbrella, such as, for example, cloth, fabric, synthetic material or any such material. Inner tube 102 is connected to canopy 101 by means of a shaft and rib assembly, as shown in more detail in FIG. 1E. Inner tube 102 also may slidingly fit or engage with outer tube 103. In other words, the radius and circumference of inner tube 102 is smaller than the radius and circumference of outer tube 103 so that inner tube 102 may fit within outer tube 103 and inner tube 102 may also be able to slide up and down within outer tube 103 as well. Outer tube 103 may also house inner tube 102 and the umbrella when the umbrella is fully retracted, and may also lock inner tube 102 into place when inner tube 102 and the umbrella (as well as the umbrella's canopy) are fully extended. A fan 104 may also be part of the umbrella backpack mechanism 100 that may cool down the user or also cool down the mechanics of the umbrella backpack mechanism 100 (such as its raise motor 105 or any lights, circuitry or other components that may get hot). Raise motor 105 controls the raising and lowering of the inner tube 102 connected to the canopy of the umbrella and also controls the contraction as well as expansion of the umbrella canopy. Raise motor 105 may be controlled, for example, by a button or switch that is located on the unit (e.g., such as button and switches 108, or could also be something that is a portable handheld unit or remote conveniently controlled by the user, or conveniently located on a front strap of the backpack, for instance). The raise motor 105 may also be powered by a battery and charger system (such as, for example, the battery box 107), or may be powered by a direct power connection, or another power source such as, for example, a solar powered unit or other similar unit. Rucksack base 106 may be a larger backwards-L shaped structure, where the flat surface of the rucksack base supports components such as, for example, the battery box 107 or the raise motor 105. The vertical surface of the rucksack base 106 may be used to align with the back of the body 110 of a user, or there may also be padding between the vertical surface of the rucksack base 106 and the back of the body 110 of the user so that the user is comfortable and that the backpack of the umbrella backpack mechanism 100 has proper support and structure for all the components it houses. Buttons and switches 108 may include buttons or switches to control the fan 104 and/or buttons or switches to control the raising and lowering of the inner tube 102 connected to the canopy 101. Also, additional buttons or switches that control other components not shown in FIG. 1A may also be included within the buttons on buttons and switches 108. Also, buttons and switches 108 may not necessarily be just on the bottom of rucksack base 106. For example, they may be on a plug in an extender flying lead that can be in a pocket, belt or hand, or part of a remote or handheld device that can be conveniently pressed, or be conveniently positioned on the front strap of a backpack for easy access by the user, for example. Drain tube 109 is connected to outer tube 103 and also inner tube 102 and may release air or fluids so as to facilitate the movement and operation of the inner tube 102 rising and lowering when controlled by the raise motor 102. The drain tube 109 also works in tandem with the raise motor 105 so as to maximize the efficiency of the raising and lowering of the umbrella and the expansion/retraction of the umbrella canopy 101. Drain tube 109 also may drain the water that could be pooling or sitting in the canopy of the umbrella when the canopy is closed (or during the closing process) to avoid excessive dripping on other surfaces, such as, for example, the user's clothes or the ground or carpet. Finally, body 110 is the body of a user that may use the umbrella backpack mechanism 100. Although FIG. 1A shows the user wearing the umbrella backpack mechanism 100 on the back of the user's body 110, the displacement and position of the umbrella backpack mechanism 100 is not limited to this configuration, and can be worn on the front, the sides, the top or bottom of the user's body 110, and may also be mounted as a unit on any structure or wall such as a chair, table, side of a house, boat, cargo ship, cargo box, stand, and so on. Therefore, body 110 may also include any of these inanimate structures, in addition to a physical human body.

Figure 1B:
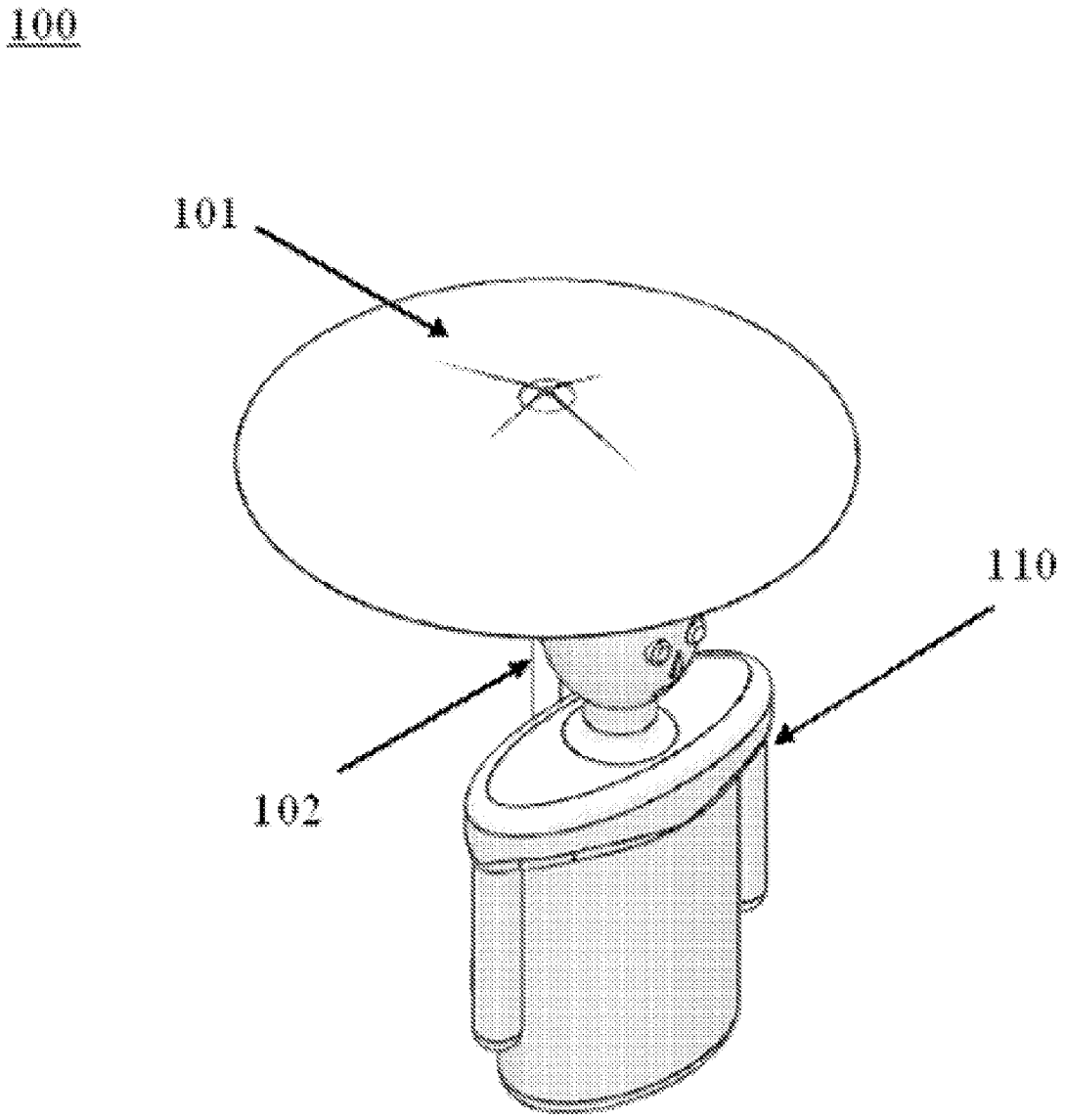
FIG. 1B illustrates an aerial front view shot of the umbrella backpack mechanism in accordance with an embodiment of the present disclosure.

FIG. 1B illustrates an aerial front view shot of the umbrella backpack mechanism in accordance with an embodiment of the present disclosure. The components are the same as discussed above for FIG. 1A. The canopy 101 and the front of the body 110 can also be more clearly seen. The inner tube 102 may also be seen in the background. Again, the umbrella backpack mechanism may not necessarily be just worn on the back of the body 110, but may also be worn on the front, side, bottom or top of the body 110 as well.

Figure 1C:
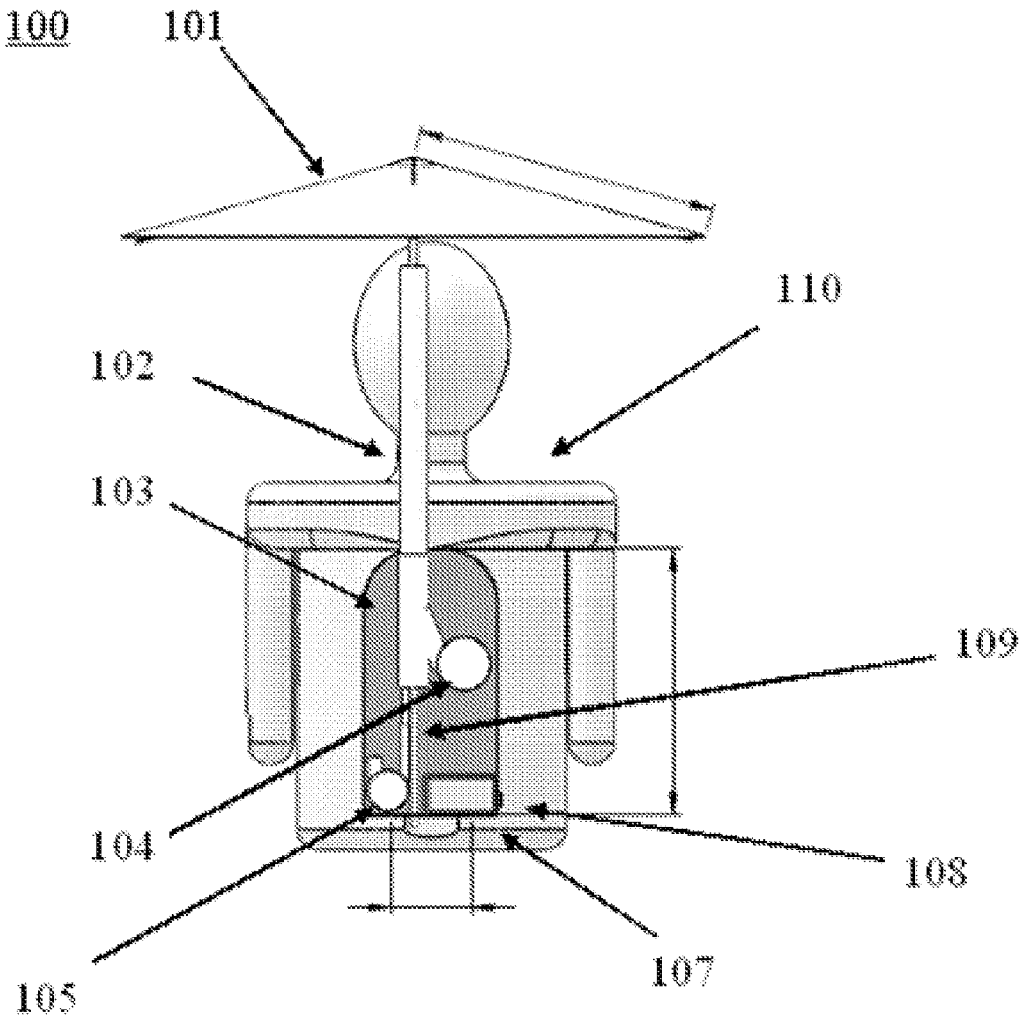
FIG. 1C illustrates a rear view shot of the umbrella backpack mechanism in accordance with an embodiment of the present disclosure.

FIG. 1C illustrates a rear view shot of the umbrella backpack mechanism in accordance with an embodiment of the present disclosure. The components are the same as discussed above for FIG. 1A. A clearer view of the rucksack base 106 as well as the fan 104, the inner tube 102, the outer tube 103, the raise motor 105 and the battery box 107 may be seen. Furthermore, even though this is shown as being on the back of body 110, it is not limited to this configuration, and may be positioned on the front, side, top or bottom of the body 110 of a user or structure.

Figure 1D:
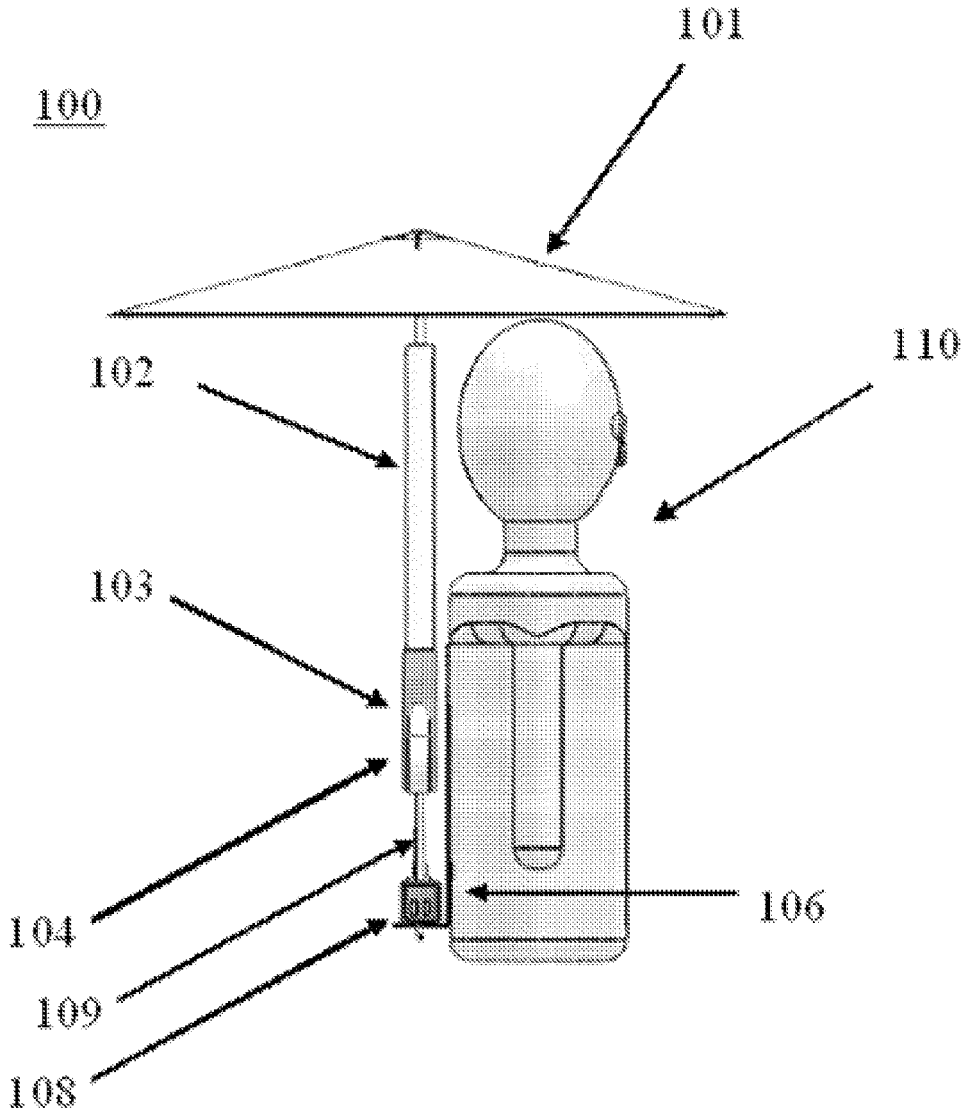
FIG. 1D illustrates a side view shot of the umbrella backpack mechanism in accordance with an embodiment of the present disclosure.

FIG. 1D illustrates a side view shot of the umbrella backpack mechanism in accordance with an embodiment of the present disclosure. The components are the same as discussed above for FIG. 1A. A clearer view of the backwards L-shape of rucksack base 106 can be seen, and also the side view of inner tube 102, outer tube 103, fan 104, drain tube 109, and buttons and switches 108 can also be seen as well. The umbrella backpack mechanism 100 also does not need to be positioned on the rear of the user's body 110 but again can be positioned on the top, bottom, front or any other configuration.

Figure 1E:
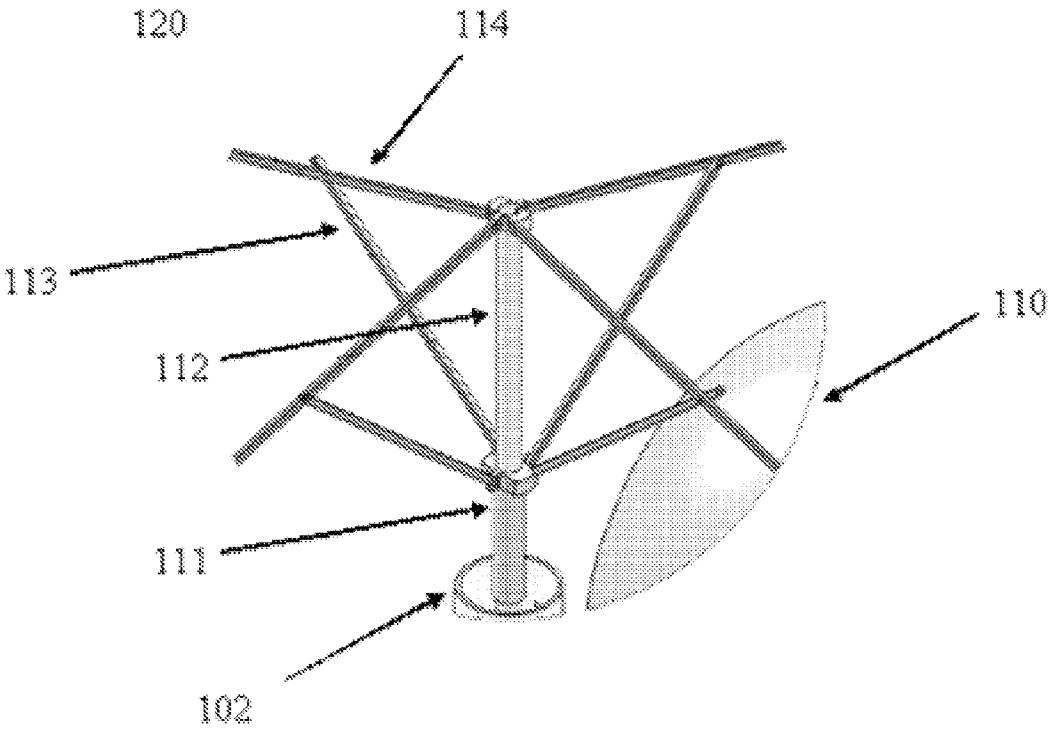
FIG. 1E illustrates a zoomed in view of the shaft and rib assembly of the umbrella backpack mechanism in accordance with an embodiment of the present disclosure.

FIG. 1E illustrates a zoomed in view of the shaft and rib assembly of the umbrella backpack mechanism in accordance with an embodiment of the present disclosure. Shaft and rim assembly 120 includes outer shaft slider 111, which fits into inner tube 102, inner shaft 112, long rib leg 113, short rib leg 114, and head of body 110. Outer shaft slider 111 comes out of inner tube 102 and slidingly engages with inner shaft 112. On outer shaft slider 111 are the rib leg 113 and short rib leg 114, which connect together with the canopy 101 of the umbrella so that when the legs are fully extended the canopy is fully formed and covering the body 110. The outer shaft slider 111 can also move along the whole length of the inner shaft 112. The short rib leg 114 and the long rib leg 113 join together in supporting the canopy of the umbrella and when the outer shaft slider 111 is moved upwards, the short rib leg 114 and long rib leg 113 are pushed outwards so as to fully extend and expand out the canopy of the umbrella. When the outer shaft slider 111 is moved downwards, the short rib leg 114 and long rib leg 113 are pushed downwards so as to retract and be placed back within the inner tube 102. The movement of the outer shaft slider 111 may be controlled by, for example, the raise motor 105, or may also be controlled manually by the user, or by some other means that can move the outer shaft slider 111 up and down the inner shaft 112. The body 110 may be a physical human body or it may also be an inanimate structure such as a chair, table, side of a house or similar such object. The inner tube 102 which the outer shaft slider 111 and inner shaft 112 go back into can be made from fabric, cloth, plastic, waterproof material or any such similar substance.

Figure 2A:
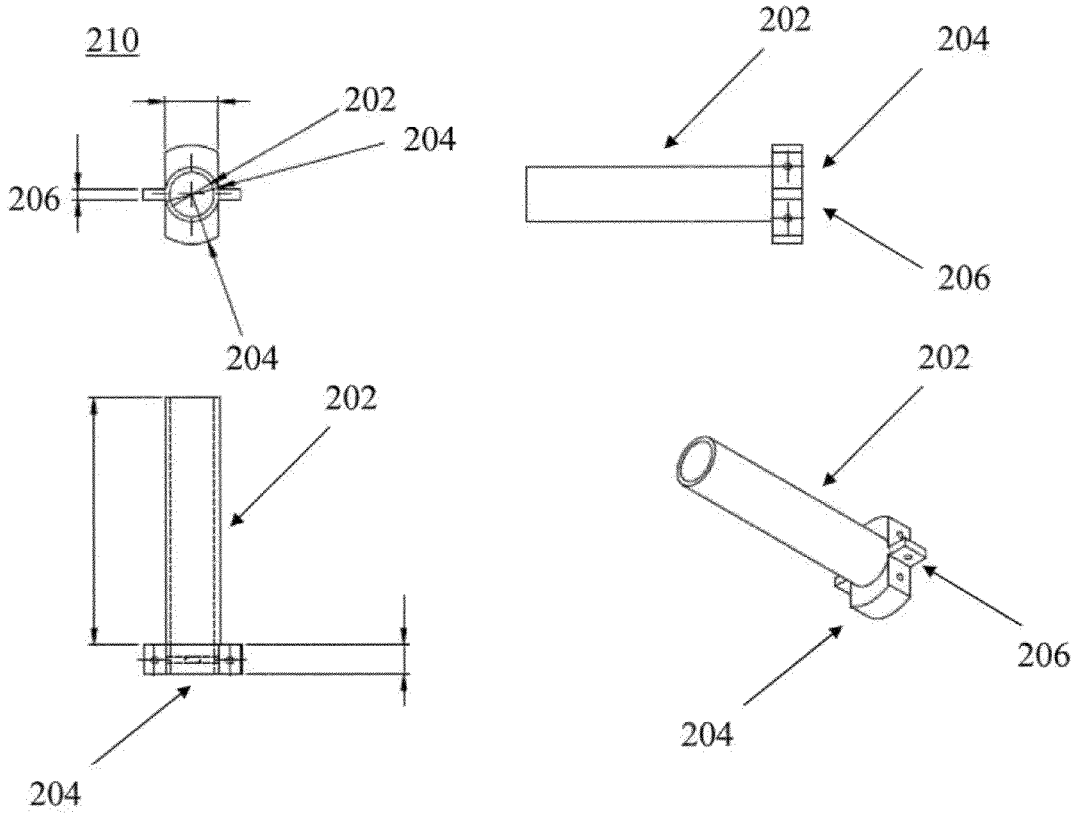
FIG. 2A illustrates an outer shaft slider to be used with the umbrella backpack mechanism in accordance with an embodiment of the present disclosure.

FIG. 2A illustrates an outer shaft slider to be used with the umbrella backpack mechanism in accordance with an embodiment of the present disclosure. Outer shaft slider 210 may be used for outer shaft slider 111 as shown in FIG. 1E. Outer shaft slider 210 includes main tube 202, first flanges 204 and second flanges 206. Main tube 202 of outer shaft slider 210 fits onto inner shaft 112 as shown in FIG. 1E. In one embodiment, the outer shaft slider may be completely hollow so that the inner shaft 112 may fit completely into it. The short rib and long rib legs 113 and 114 may engage with either or both of the first and second flanges 204 and 206, so that when the main tube 202 of the outer shaft slider 210 moves along the inner shaft 212, the first and second flanges 204 and 206 push outwards the short rib and long rib legs 113 and 114 and fully extend them so that the canopy of the umbrella may be fully expanded and extended. FIG. 2A shows different angles, sides and views of the outer shaft slider 210. Also, the shape of the outer shaft slider 111 is not limited to the shape shown and can take on a variety of different shapes.

Figure 2B:
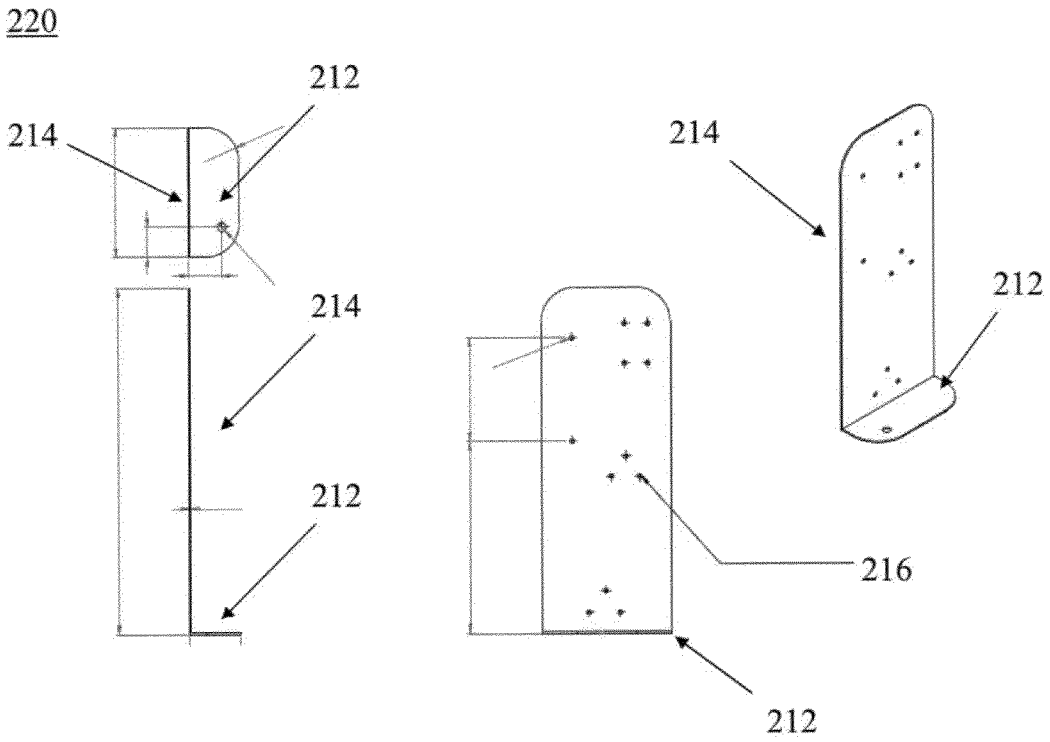
FIG. 2B illustrates a base to be used with the umbrella backpack mechanism in accordance with an embodiment of the present disclosure.

FIG. 2B illustrates a base to be used with the umbrella backpack mechanism in accordance with an embodiment of the present disclosure. Base 220 may be used for rucksack base as discussed in FIGS. 1A-1D above. Base 220 includes a horizontal surface 212 and a vertical surface 214. As shown in FIG. 2B, the horizontal surface 212 and the vertical surface 214 may abut to form a "L"-shape. However, the configuration of the base 220 is not limited to this configuration shown and can take on a number of different alternatives. Furthermore, components such as a battery box 107 or buttons and switches 108 or other components may be placed or secured on the horizontal surface 212 in the overall structure of the backpack so as to not fall and can also be firmly adhered into place. Rivets 216 may be used to nail, affix or secure other components used in the umbrella backpack mechanism, such as, for example, inner tube 102, outer tube 103, fan 104, raise motor 105, battery box 107, buttons and switches 108, drain tube 109, and other similar components. Rivets 216 may also be used to affix a pulley system used by the raise motor 105. The base may be made from cardboard, plastic, synthetic material, durable material, hard cloth or fabric, or any other such materials.

Figure 2C:
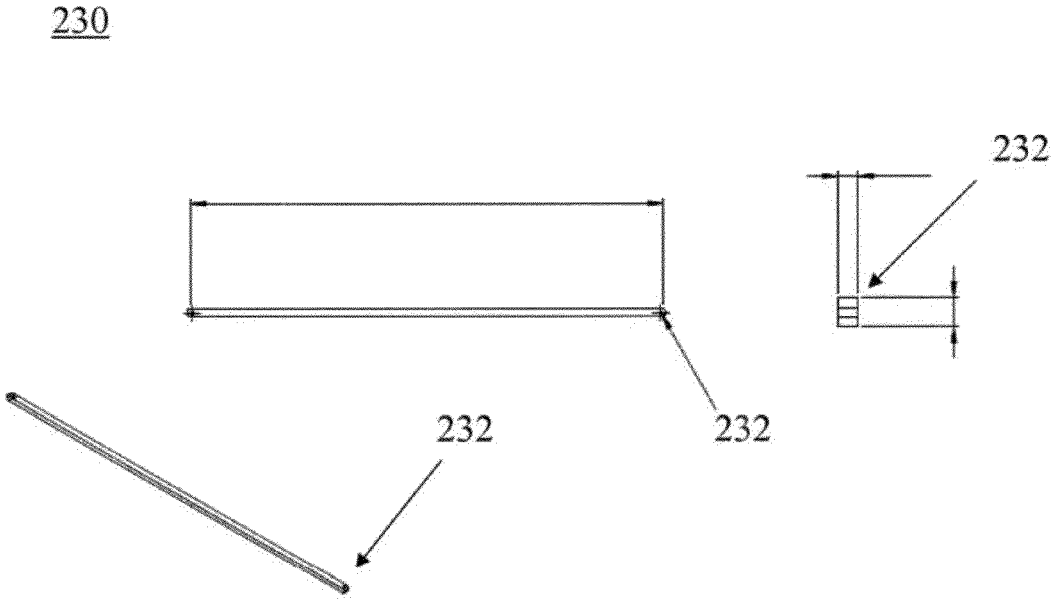
FIG. 2C illustrates a rib leg to be used with the umbrella backpack mechanism in accordance with an embodiment of the present disclosure.

FIG. 2C illustrates a rib leg to be used with the umbrella backpack mechanism in accordance with an embodiment of the present disclosure. Rib leg 230 may be used as short rib leg 114 and long rib leg 113 as discussed in FIG. 1E, but since it is shorter than the rib leg shown in FIG. 2D, it may more likely be used as short rib leg 114. Rib leg 230 has a tip 232. The tip 232 engages with corresponding locations on the canopy of the umbrella. The tip 232 on the other end may also engage with the first flanges 204 and second flanges 206 of the outer shaft slider 210, so that when the outer shaft slider 210 (or outer shaft slider 111) moves up and down inner shaft 112, the rib leg 230 moves along with it in order to expand or contract the canopy of the umbrella accordingly. The rib leg 230 may be made from metal, plastic, synthetic materials, fiber, or any such similar material.

Figure 2D:
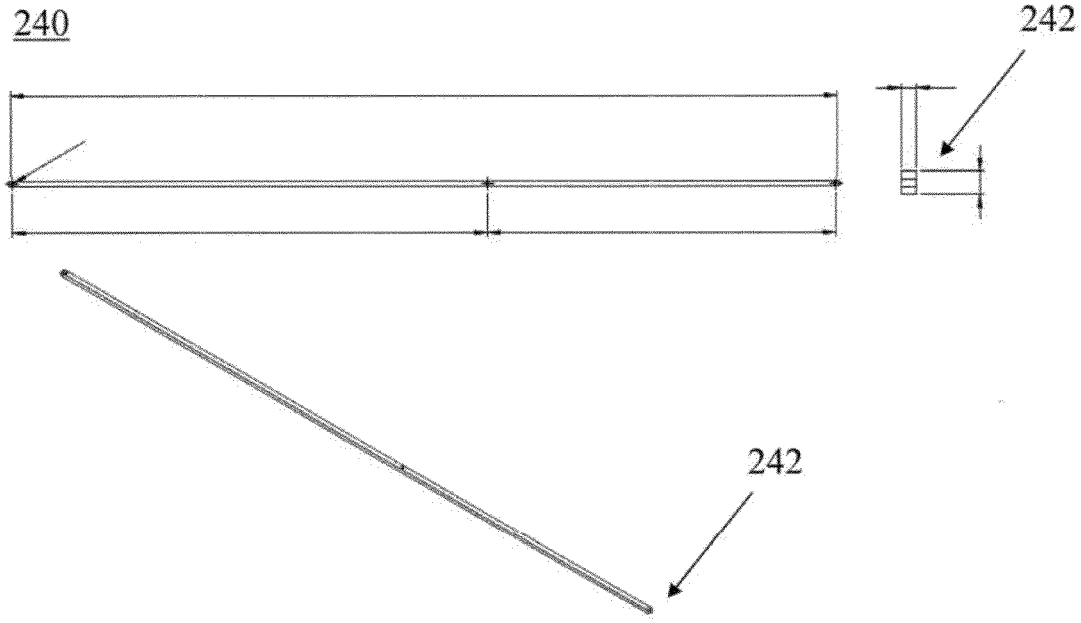
FIG. 2D illustrates another rib leg to be used with the umbrella backpack mechanism in accordance with an embodiment of the present disclosure.

FIG. 2D illustrates another rib leg to be used with the umbrella backpack mechanism in accordance with an embodiment of the present disclosure. Rib leg 240 may be used as short rib leg 114 and long rib leg 113 as discussed in FIG. 1E, but since it is longer than the rib leg shown in FIG. 2C, it may more likely be used as long rib leg 113. Rib leg 240 also has a tip 242, and its purpose is identical to the discussion of the tip 232 in FIG. 2C. The rib leg 240 may be made from metal, plastic, synthetic materials, fiber, or any such similar material.

Figure 2E:
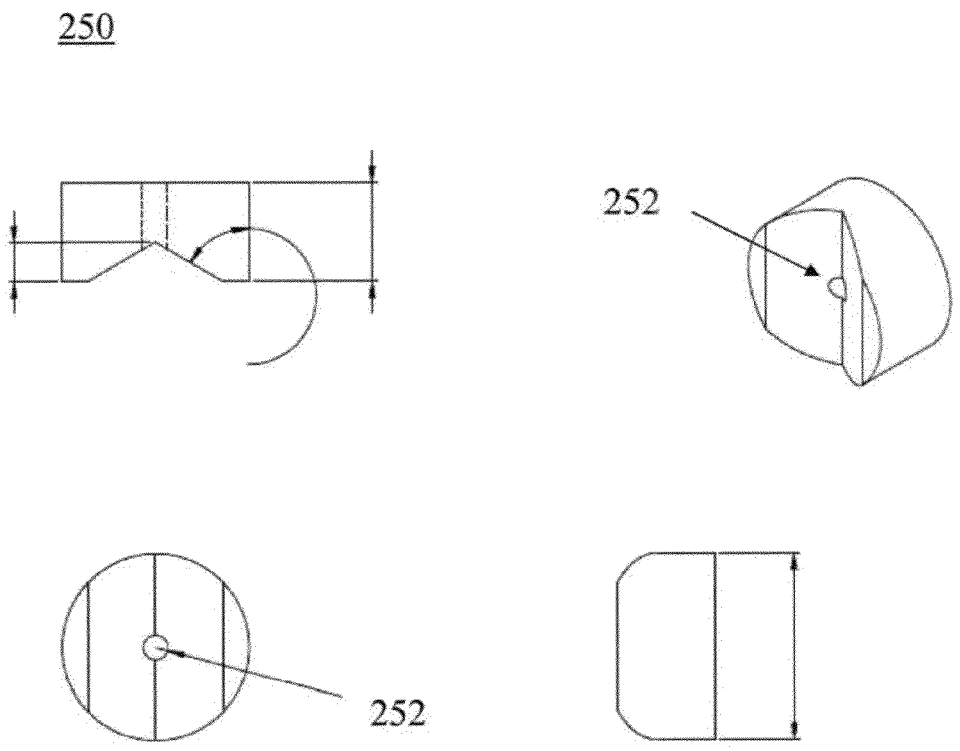
FIG. 2E illustrates a spacer to be used with the umbrella backpack mechanism in accordance with an embodiment of the present disclosure.

FIG. 2E illustrates a spacer to be used with the umbrella backpack mechanism in accordance with an embodiment of the present disclosure. The spacer 250 may be used in tandem with any of the above-mentioned components. The spacer 250 may be used to space apart different components, or may also be used for support, separation or other such related purposes. The spacer 250 also may have a hole 252 as well to fittingly engage other components as well. Shown in FIG. 2E are other views of the spacer 250 as well.

Figure 2F:
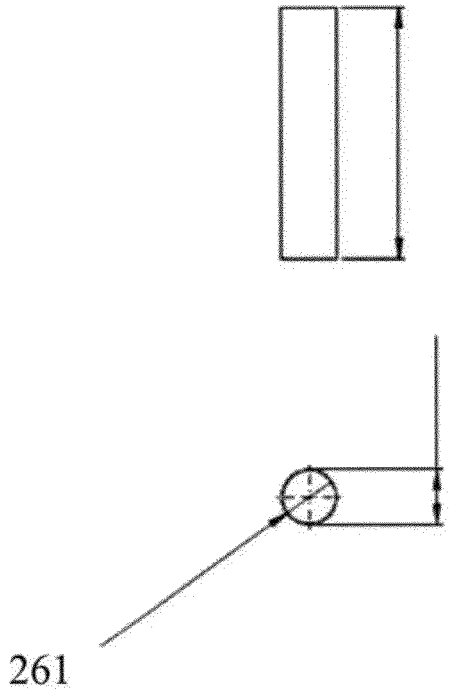
FIG. 2F illustrates an outer tube to be used with the umbrella backpack mechanism in accordance with an embodiment of the present disclosure.

FIG. 2F illustrates an outer tube to be used with the umbrella backpack mechanism in accordance with an embodiment of the present disclosure. Outer tube 260 may be used as, for example, outer tube 103 as discussed in FIGS. 1A-1D. Outer tube 260 has a main tube 261 which may be, in one embodiment, completely hollow so as to fittingly engage an inner tube (for instance inner tube 102, for example) or another such sliding object. The outer tube 260 may be made from metal, plastic, fiber, any hard, resilient material or any other such material.

Figure 2G:
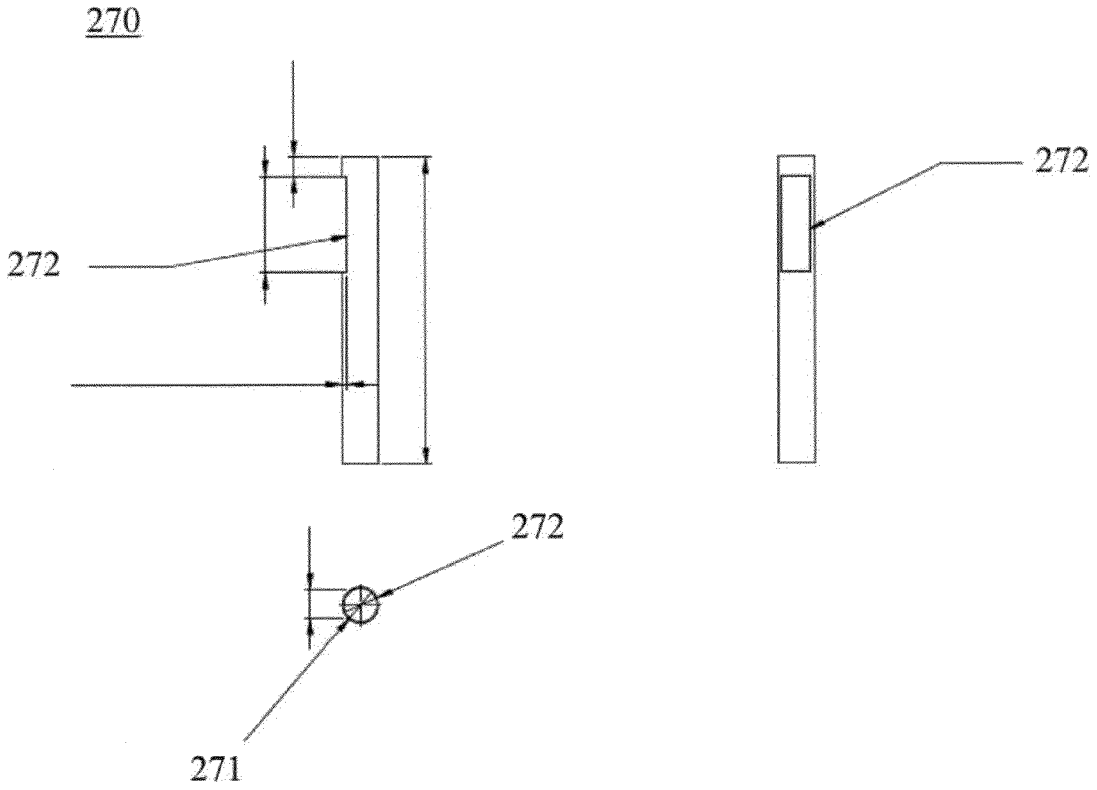
FIG. 2G illustrates an inner tube to be used with the umbrella backpack mechanism in accordance with an embodiment of the present disclosure.

FIG. 2G illustrates an inner tube to be used with the umbrella backpack mechanism in accordance with an embodiment of the present disclosure. Inner tube 270 may be used as, for example, inner tube 102 as discussed in FIGS. 1A-1D. Inner tube 270 has a main tube 271 which may be, in one embodiment, completely filled in so as to engage with an outer tube that is completely hollow. In one embodiment, the main tube 271 may be completely hollow. Inner tube 270 also has an air vent 272. Air vent 272 may facilitate the release of air, pressure or fluids from the movement of the inner tube 270 up and down within an outer tube to make, for example, an umbrella contract or expand. Air vent 272 may also work in tandem with, for example, the drain tube 109. Air vent 272 may also be used to aid in air circulation or the release of air from certain channels in the umbrella backpack mechanism.

Figure 2H:
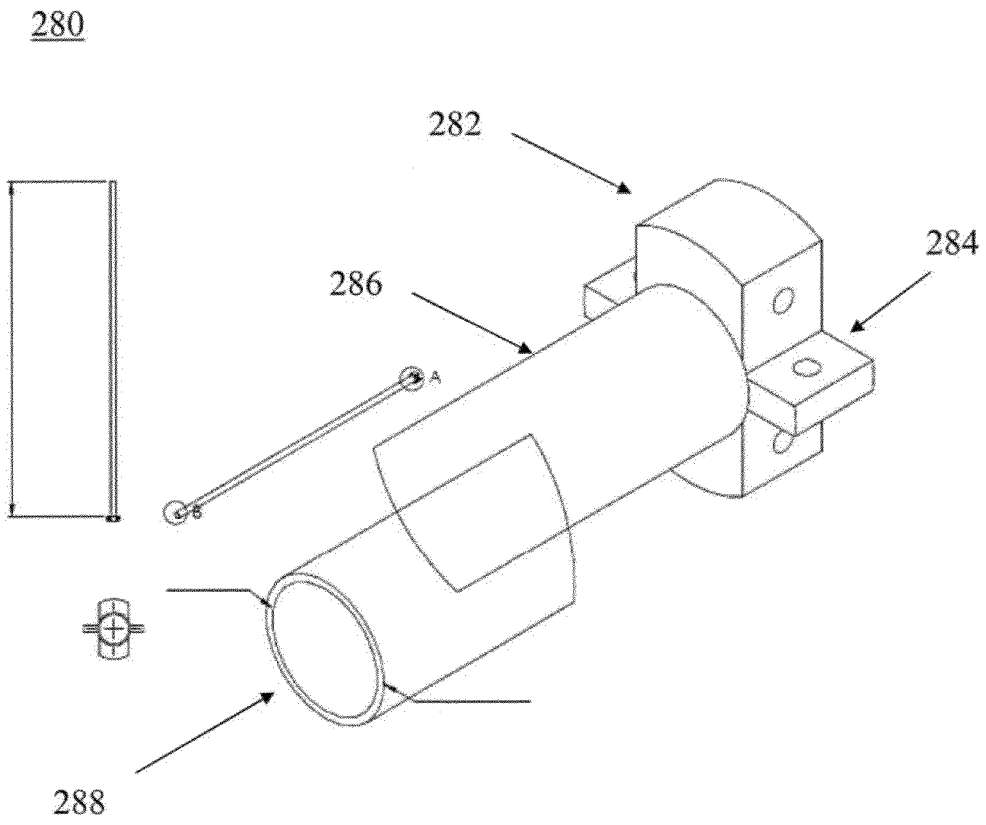
FIG. 2H illustrates a blown-up shot of an inner shaft to be used with the umbrella backpack mechanism in accordance with an embodiment of the present disclosure.

FIG. 2H illustrates a blown-up shot of an inner shaft to be used with the umbrella backpack mechanism in accordance with an embodiment of the present disclosure. Inner shaft structure 280 includes a first flange 282, a second flange 284, a tube structure 286 and a main cavity 288. The first flange 282 and second flange 284 are similar to the first flanges 204 and second flanges 206 of the outer shaft slider 210 discussed above in FIG. 2A, and the entire structure of the tube structure 286 and the first and second flanges 282 and 284 is very similar to the outer shaft slider 210 of FIG. 2A. The entire structure of 286, 282 and 284 may slidingly engage with an inner shaft in order to move up and down in order to contract or expand an umbrella. There are other views of the inner shaft shown in FIG. 2H as well.

Figure 3:
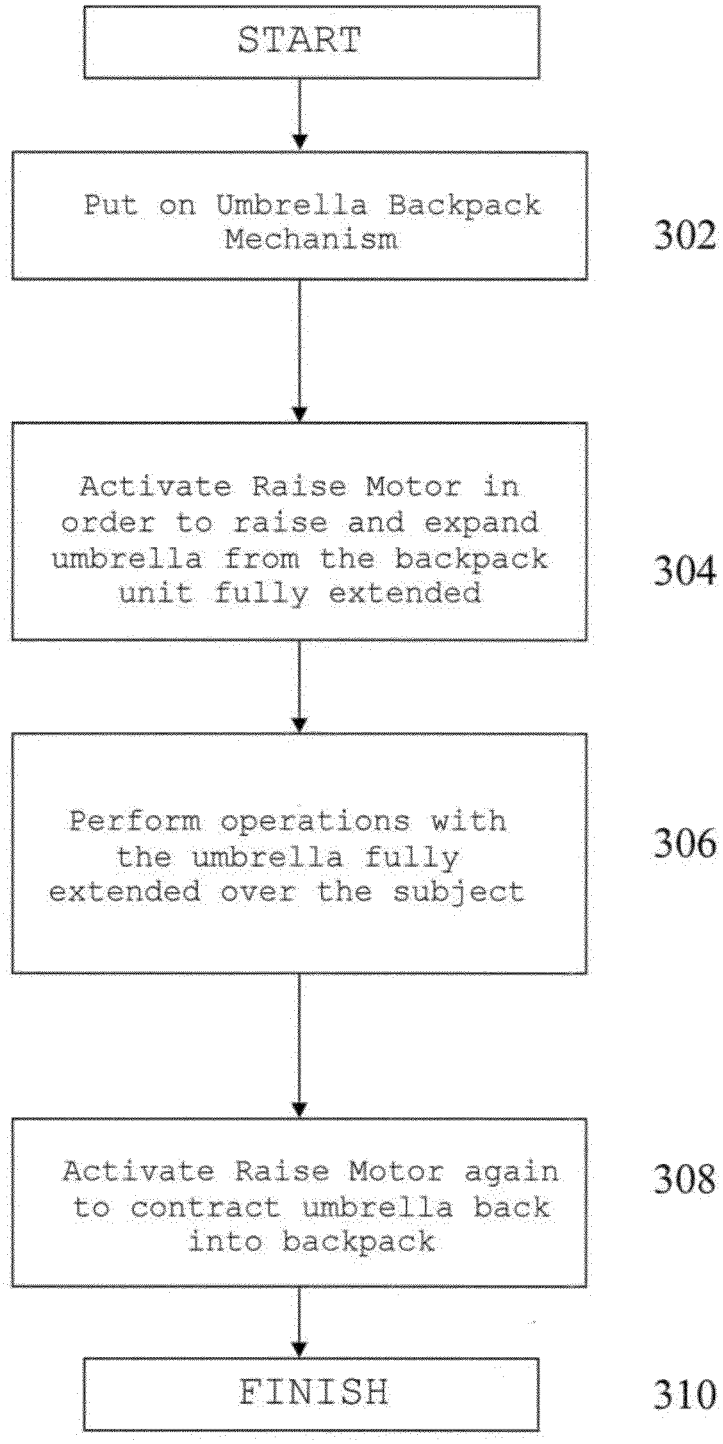
FIG. 3 illustrates a method flowchart in accordance with an embodiment of the present disclosure.

FIG. 3 illustrates a method flowchart in accordance with an embodiment of the present disclosure. Once method 300 starts, in step 302, the umbrella back mechanism is put on the subject. This could mean that a user (e.g., a physical human being or animal) places the backpack at a convenient location, for example, puts it on his or her back with the backpack's shoulder straps. This could also mean the backpack is placed on a structure or other stationary object such as a chair, table, side of a house, boat, and so on. In step 304, the raise motor is activated in order to raise and expand the umbrella from the backpack unit until the canopy of the umbrella is fully extended. This could mean pressing buttons or switches located at the rear or bottom of the backpack unit, pressing a button on a remote or handheld unit, pressing a button located conveniently on a shoulder strap, or otherwise activating the raise motor in a fashion convenient to the user. In step 306, operations are performed with the umbrella fully extended over the subject. For a physical human being or person, this could mean having one's hands free to do other things such as operating a phone or sending text messages with a phone, engaging in physical activities or outdoor sports, or otherwise performing actions that would require the use of two, free hands. In the case of a structure or object, it could mean either leaving the premises to perform other tasks where a given area is protected from rain, snow or the weather or shaded, or it could mean being able to fully set-up an area that is now protected from rain, snow or the weather or shaded, or just protecting a given area or structure from the elements. In step 308, after the operations are performed in step 306, the raise motor is activated again and the umbrella is contracted again and placed back into the backpack unit. Again, the raise motor may be activated in a number of ways, as discussed previously for step 304. Finally, in step 310, method 300 ends and may be repeated.

Figure 4A:
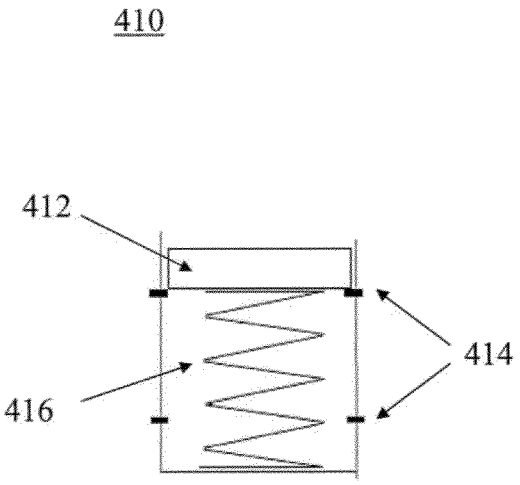
FIG. 4A illustrates a primary lift spring apparatus in accordance with an embodiment of the present disclosure.

FIG. 4A illustrates a primary lift spring apparatus in accordance with an embodiment of the present disclosure. Primary lift spring apparatus 410 includes primary lift spring 416, base 412, base latches 414. Base latches 414 securely latch the base 412 to the primarily lift spring 416. Base latches 414 may be manual releasable latches or electrically releasable latches at the lower and top position of the umbrella base, for example, or spring activated and held off by an electrical solenoid, for example, as and when required. Primary lift spring 416 may be made from metal (such, as for example, chrome, chrome silicon, chrome vanadium, stainless steel, any alloy of steel, inconel, monel, beryllium, copper, phosphor bronze, titanium, oil tempered wire, music wire), plastic, or any other similarly hard material. Base 412 and base latches 414 may also be made of similar metal, plastic, fiberglass or any other similarly hard material.

Figure 4B:
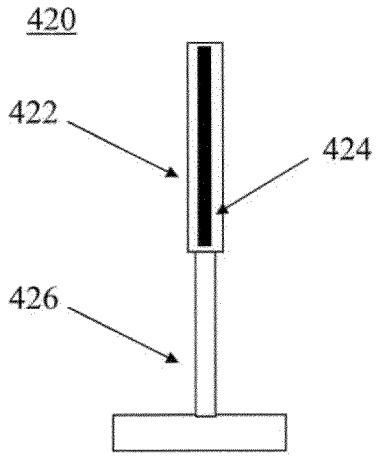
FIG. 4B illustrates a main riser apparatus in accordance with an embodiment of the present disclosure.

FIG. 4B illustrates a main riser apparatus in accordance with an embodiment of the present disclosure. Main riser apparatus 420 includes main riser 426, canopy section 422, and secondary lift spring 424 (which cannot be seen as it is under the canopy section 422 in FIG. 4B). The canopy section 422 is the section containing the canopy for the umbrella used in the umbrella backpack mechanism and may also include a canopy slider that enables the canopy section 422 to slide up and down over the main riser 426, and the canopy slider may be located on the canopy section 422 to keep the slider moving over one section. The secondary lift spring 424 acts between the top of the main riser 426 and the top of the canopy section 422. The secondary lift spring 424 may be made from metal (such, as for example, chrome, chrome silicon, chrome vanadium, stainless steel, any alloy of steel, inconel, monel, beryllium, copper, phosphor bronze, titanium, oil tempered wire, music wire), plastic, or any other similarly hard material. Main riser 426 supports and lifts canopy section 426 up and fully expands the canopy section 426 so that it may cover the user. Main riser 426 may also be made of similar metal, plastic, fiberglass or any other similarly hard material. The hard parts of canopy section 422 may be made from similar metal, plastic, fiberglass or any other similarly hard material, and the canopy may be made of cloth, fabric or any other material that canopies are usually made from.

Figure 4C:
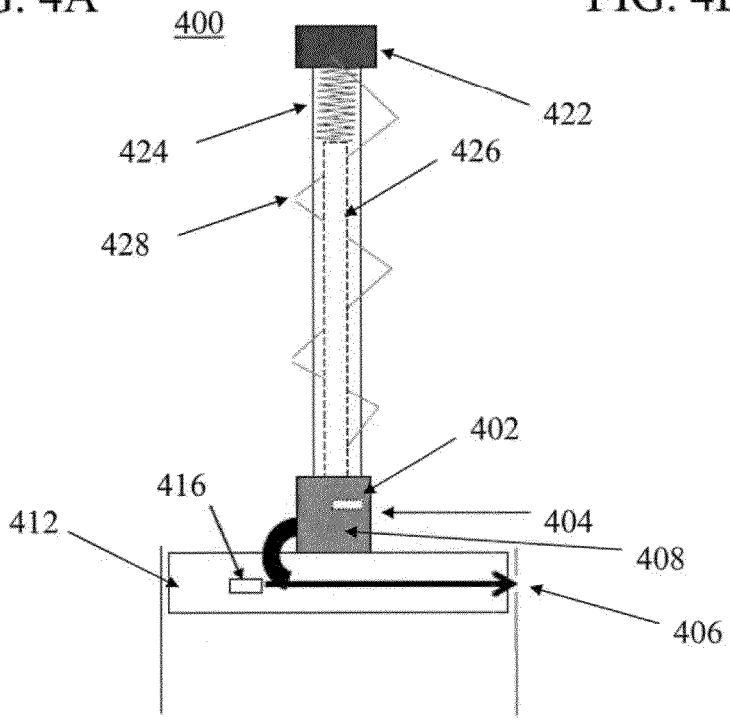
FIG. 4C illustrates an overall lift apparatus in accordance with an embodiment of the present disclosure.

FIG. 4C illustrates an overall lift apparatus in accordance with an embodiment of the present disclosure. Overall lift apparatus 400 may be used with the umbrella backpack mechanism described above and positioned on the rear or front of the umbrella backpack mechanism in order to raise and lower the umbrella or canopy section from the umbrella backpack mechanism over the user. Overall lift apparatus 400 includes canopy section 422, main riser 426, secondary lift spring 424, canopy opening spring 428, primary lift spring 416 (shown completely contracted); base 412; canopy section and slider latch 402; canopy slider and base latch 404; and hole 406. Canopy section 422 and main riser 426 are described above, and main riser 426 supports and raises canopy section 422. Secondary lift spring 424 and primary lift spring 416 are the same as described above, but primary lift spring 416 is shown in FIG. 4C as being completely contracted. Canopy opening spring 428 is the spring attached to the canopy section 422 that pushes the canopy section 422 outward and assists in fully expanding and extending the canopy section 422 outward so that the canopy of the canopy section 422 may eventually expand or extend over the user. Base 412 is the same as described above. Canopy section and slider latch 402 is a latch that locks the canopy slider 408 to the canopy section 422. When the canopy section and slider latch 402 is released, the canopy opening spring 428 will expand (or in one embodiment, contract or close up) and open up the canopy, or can be configured to close up the canopy. The canopy section and slider latch 402 may be released by the end of travel up the main riser 426. Canopy slider and base latch 404 latches and locks the canopy slider 408 to the base 412. The canopy slider and base latch 404 is released when the base 412 reaches the end of the lift or lift end. The canopy slider and base latch 404 is re-applied when the base 412 is completely pulled down. Hole 406 allows the canopy slider and base latch 404 to be released. In one embodiment, hole 406 may also allow the canopy section and slider latch 402 to release, in addition to the canopy slider and base latch 404. Pulling down on the base 412 will push the slider latch arm of the canopy slider and base latch 404 back, thereby applying the latch. The canopy section and slider latch 402 and the canopy slider and base latch 404 may be made from metal, plastic, fiberglass or any other similarly hard material.

Figure 5A:
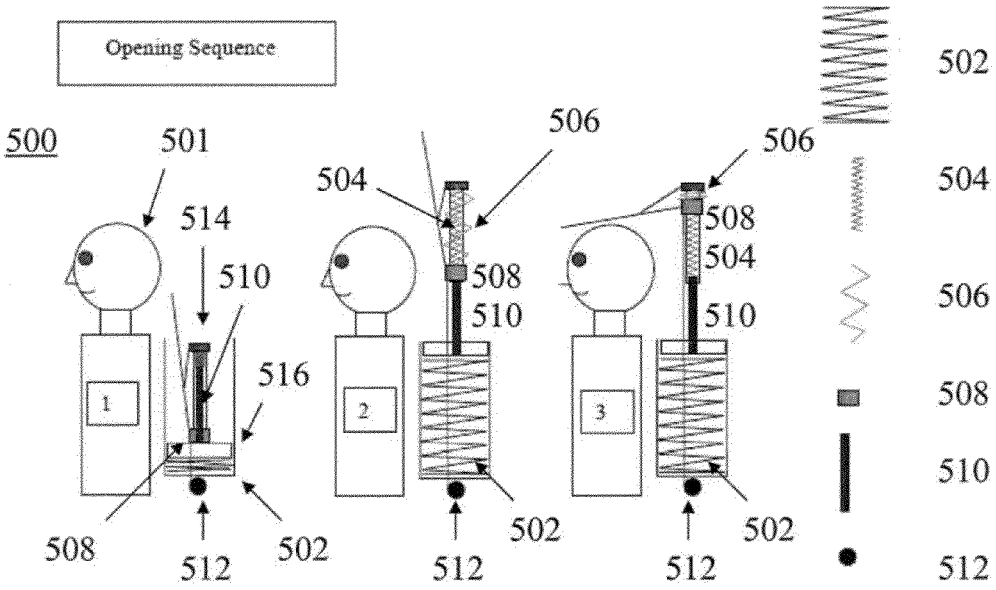
FIG. 5A illustrates an opening sequence in accordance with an embodiment of the present disclosure.

FIG. 5A illustrates an opening sequence in accordance with an embodiment of the present disclosure. Umbrella backpack mechanism setup 500 includes user 501, primarily lift spring 502, secondary lift spring 504, canopy opening spring 506, canopy slider 506, main riser 510, and motor retrieval drum 512, canopy section 514 and base 516. All the components have been discussed above, except for the motor retrieval drum 512, which runs the motor to operate the raising and lowering of the various components as well as the contraction and expansion of the various springs and other related components. In scenario 1, in one embodiment the start position, a latch is released (such as, for example, the canopy slider and base latch 404 or the canopy section and slider latch 402 described above), causing the primary lift spring 502 to expand and pushing the base 516 up and lifting the umbrella and the canopy section 514. In scenario 2, the umbrella base 516 reaches a stopping point where it stops rising and the canopy section 514 lifts by means of the secondary lift spring 504 expanding between the main riser 510 and the top of the canopy section 514. In scenario 3, the canopy slider latch is released (e.g., the canopy section and slider latch 402, described above), possibly by means of a lever mechanism linked to the main riser 510 and the canopy opening spring 506 closes (or expands) and therefore opens up the canopy and fully expanding the canopy of the umbrella so as it fully covers the user. During the raise and open operation, the motor retrieval drum 512 may be freewheeling or may incur a slight back tension. The motor retrieval drum 512 may also be made of metal, plastic, fiberglass or any other similarly hard material. For opening, the base safety latches holding the umbrella base 516 down against the primary lift spring 502 (e.g., canopy slider and base latch 404) may be released physically or mechanically, or electromechanically. The primary lift spring 502 raises the base 516 to the end of the movement for the base 516 (where the base 516 may not be raised any longer) and other base latches are applied (e.g., canopy section and slider latch 402). The canopy slider 506 is then released from the base 516, but the canopy slider 506 may still be locked to the canopy section 514. The secondary lift spring 504 will lift the canopy section 514 to its limit (lifting it to a point where it can no longer lift any higher). As the canopy section 514 reaches the mechanical stop limit on the main riser 510, the canopy slider latch (e.g., canopy section and slider latch 402) is released previously tying down the canopy section 514 so that the canopy open spring 506 may close up (or expand) in order to open up the canopy of the umbrella so that the canopy of the umbrella fully extends over the user. During the above movement, the motor retrieval drum 512 may be unwinding—this movement may be under dynamic breaking movement in order to keep the retrieval wire taught.

Figure 5B:
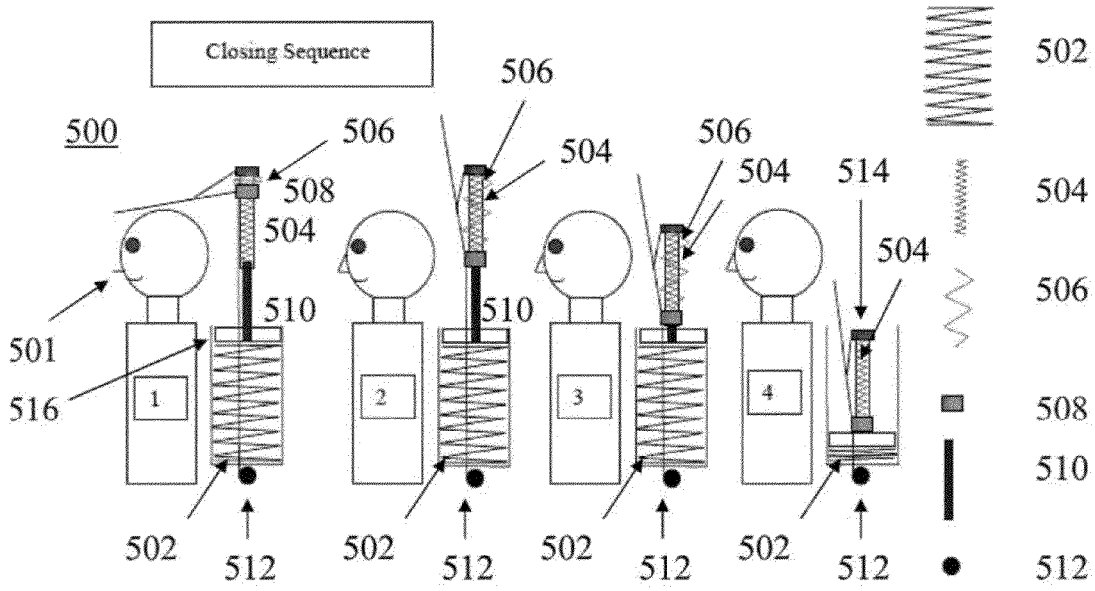
FIG. 5B illustrates a closing sequence in accordance with an embodiment of the present disclosure.

FIG. 5B illustrates a closing sequence in accordance with an embodiment of the present disclosure. Umbrella backpack mechanism setup 500 includes user 501, primarily lift spring 502, secondary lift spring 504, canopy opening spring 506, canopy slider 506, main riser 510, and motor retrieval drum 512, canopy section 514 and base 516, and all these components have been described above. In scenario 1, in one embodiment the start position, the motor connected to the motor retrieval drum 512 starts to run and pulls down on the canopy slider 506. In scenario 2, the canopy of the canopy section 514 closes and the canopy opening spring 506 is forced to extend. The canopy slider latch (e.g., the canopy section and slider latch 402, described above), may be latched. In scenario 3, the motor connected to the motor retrieval drum 512 pulls the canopy section down until the main base 516 reaches its limit and cannot go down any further. In scenario 4, the motor connected to the motor retrieval drum 512 continues to pull downwards, bringing the closed umbrella into a container such as a storage box, for example. The motor connected to the motor retrieval drum 512 may rotate the motor retrieval drum 512 and pull down the canopy slider 506. The canopy opening spring 506 is weaker than the secondary lift spring 504 and so the canopy closes as the canopy opening spring 506 is extended. When the canopy slider 506 reaches the end of the canopy section 514 (the canopy slider 506 cannot extend any lower) the pull is now focused on the secondary lift spring 504, which is compressed as the canopy section 514 moves down over the main riser 510. Also, the latch between the canopy slider 506 and the canopy section 514 is locked (e.g., the canopy section and slider latch 402, described above). When the canopy section 514 reaches the base (and when it cannot extend any lower), the base latches may be released (e.g., the canopy slider and base latch 404) and the base 516 moves down and the canopy slider to the base latch is secured via a connection. Finally, when the base 516 reaches the bottom of the storage container (e.g., a storage box) and the relevant base latches are applied, the motor stops. The umbrella then is completely contracted and rests with its canopy completely withdrawn.

Figure 6A:
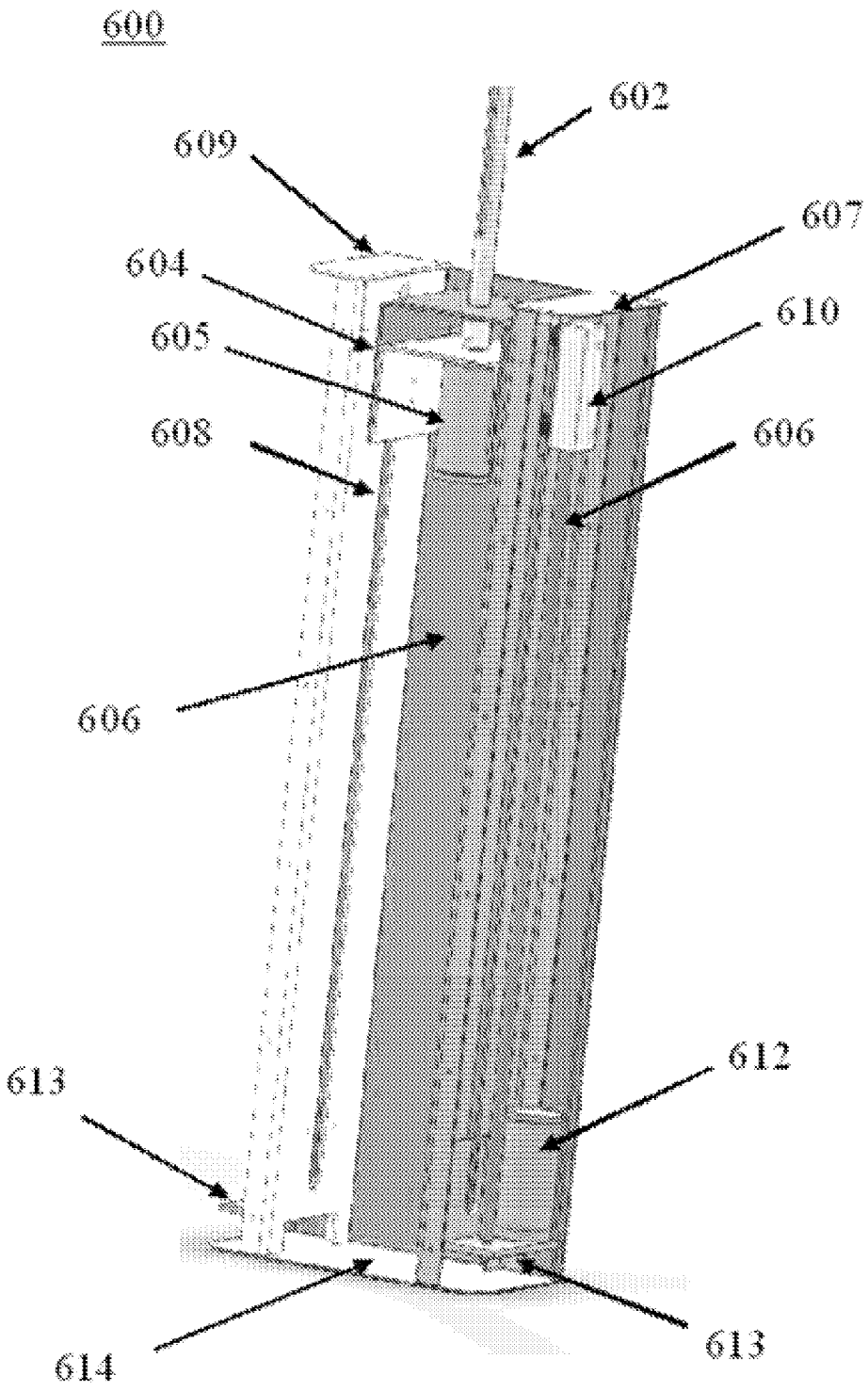
FIG. 6A illustrates a case apparatus for an umbrella backpack mechanism in accordance with an embodiment of the present disclosure.

FIG. 6A illustrates a case apparatus for an umbrella backpack mechanism in accordance with an embodiment of the present disclosure. Case apparatus 600 includes: umbrella carriage 602, left top plate 609, right top plate 607, rod assembly 604, rod 605, left side channel 608, main drive screw 610, right side channel 606, back plate 606, motor 612, motor bracket 613 and bottom plate 614. Umbrella carriage 602 may hold up an umbrella or canvas and may be connected to the base or handle of an umbrella having a canvas. Left top plate 609 forms the top of the left side channel 608, and right top plate 607 forms the top of the right side channel 606. Rod assembly 604 is the main unit that carries the entire umbrella and that moves it up and down along the length of the case assembly 600 when the umbrella is contracting or expanding. Rod 605 may also be used for further support of the umbrella or to house umbrella components, or may be used to house a motor to facilitate the upwards and downwards movement of rod assembly 604, or may be an actual motor itself. Rod assembly 604 moves upwards and downwards alongside the left side channel 608 and the right side channel 606, and the movement of the rod assembly is capped on the top side by left top plate 609 and right top plate 607 and at the bottom side by motor brackets 613. Main drive screw 610 is the component that secures the right side channel 606 and the left side channel 608 securely to the frame of the case apparatus 600. Back plate 606 is the secure backing cover that protects the inner components of the case assembly 600 from rain or other weather, and which encloses all the components of case assembly 600 (many components which are not shown here, but are shown in other Figures). Motor 612 is a driving motor that may control the upwards and downwards motion of the rod assembly 604 as the umbrella contracts and expands. Motor 612 may also work in tandem with rod 605, if rod 605 is also a motor. The motor bracket 613 holds the motor 612 up and provides bottom support for both the right side channel 606 and left side channel 608. The bottom plate 614 provides the bottom-most support for the case apparatus 600 so as to enclose and house the entire structure.

Figure 6B:
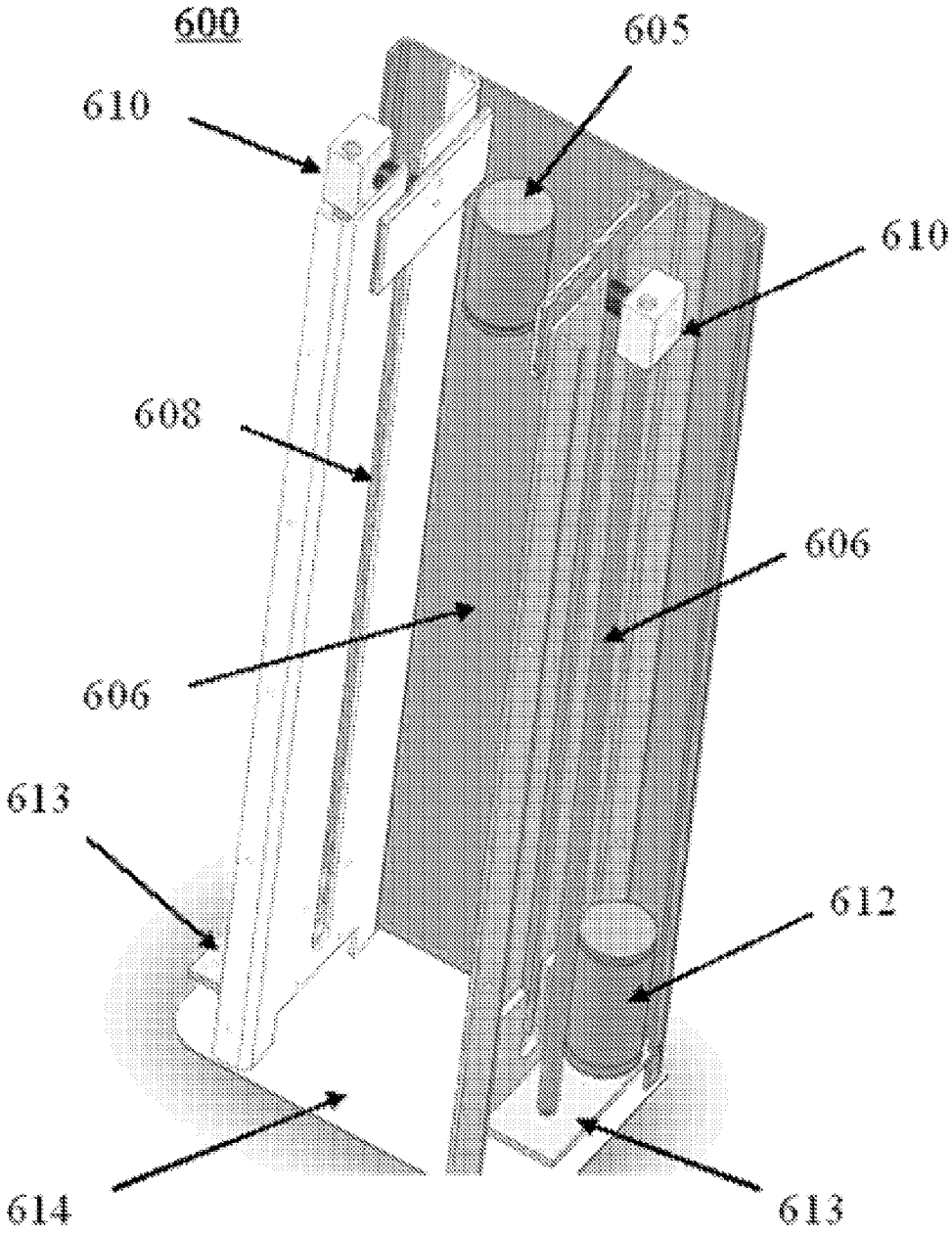
FIG. 6B illustrates a case apparatus for an umbrella backpack mechanism in accordance with an embodiment of the present disclosure.

FIG. 6B illustrates a case apparatus for an umbrella backpack mechanism in accordance with an embodiment of the present disclosure. All the components of case assembly 600 are described above in FIG. 6A, however FIG. 6B provides a better view of components such as the bottom plate 614, the rod 605, the main drive screw 610 and other such components. Many other components (not shown) may also fill up the empty space revealed within the case assembly 600.

Figure 6C:
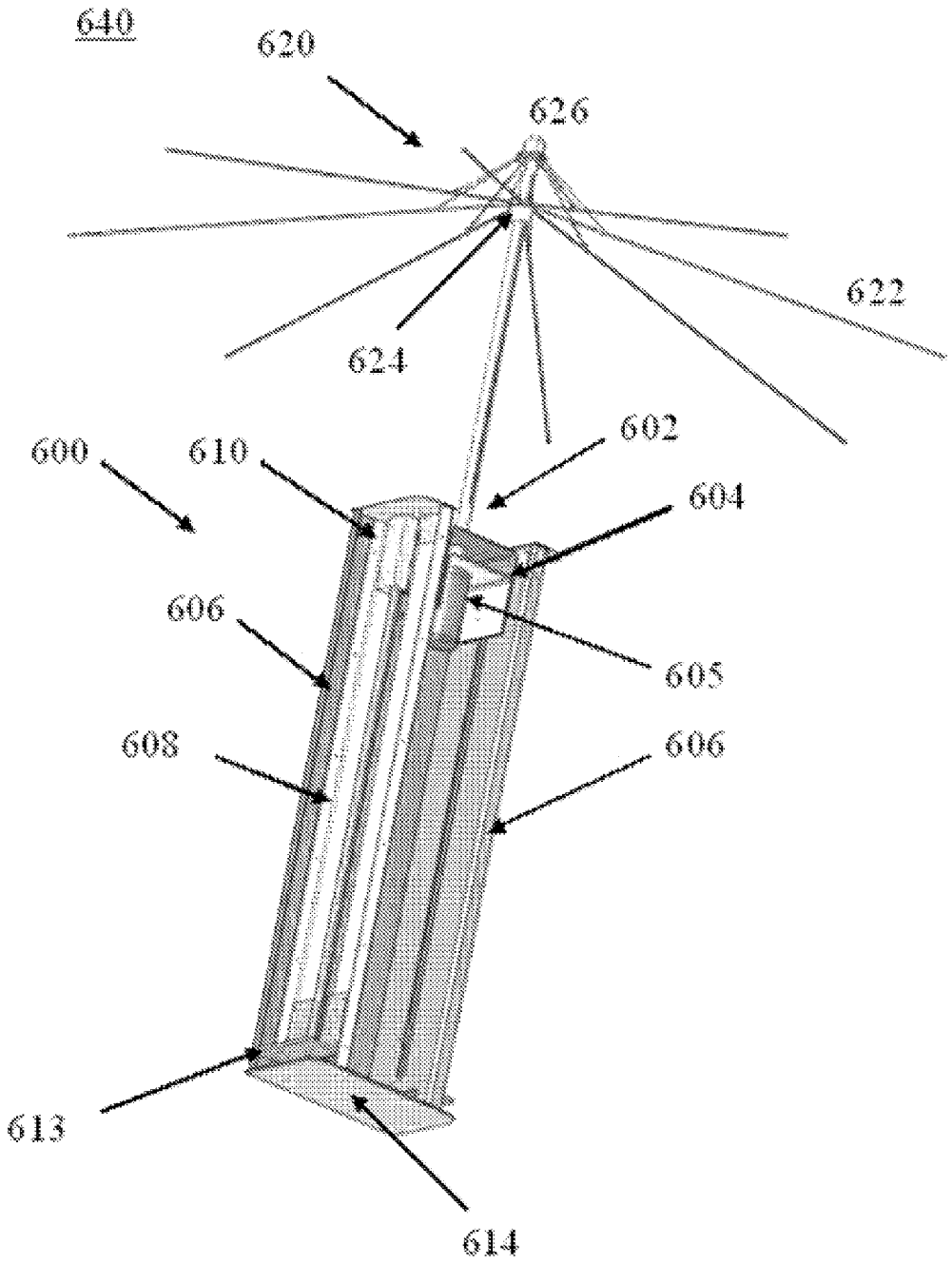
FIG. 6C illustrates a case apparatus and a canopy frame assembly for an umbrella backpack mechanism in accordance with an embodiment of the present disclosure.

FIG. 6C illustrates a case apparatus and a canopy frame assembly for an umbrella backpack mechanism in accordance with an embodiment of the present disclosure. Case apparatus and canopy frame assembly 640 includes the case apparatus 600 discussed previously, as well as a canopy frame assembly 620, which includes canopy arms 622, canopy pivot 624 and canopy fulcrum 626. Umbrella carriage 602 also is shown as the main pole/rod support that holds up the canopy of the umbrella. The other components of case assembly 600 were discussed in the previous Figures but are shown at this different angle. The bottom plate 614, for instance, can be more clearly seen, as can components like the motor bracket 613.

Figure 6D:
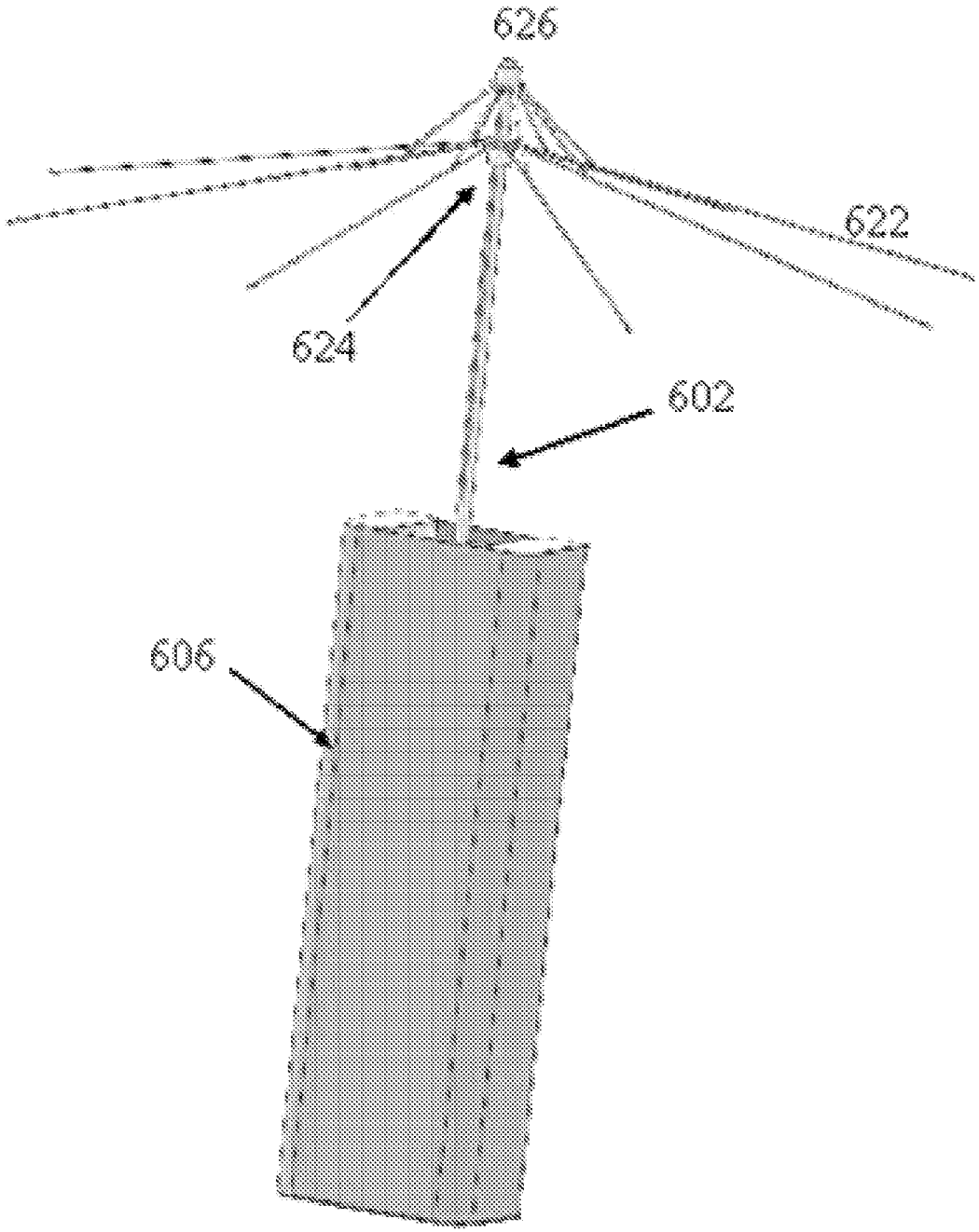
FIG. 6D illustrates a case apparatus and a canopy frame assembly for an umbrella backpack mechanism in accordance with an embodiment of the present disclosure.

FIG. 6D illustrates a case apparatus and a canopy frame assembly for an umbrella backpack mechanism in accordance with an embodiment of the present disclosure. The components shown in FIG. 6D are described above in FIG. 6C. However, in this rear view, the back of back panel 606 can be seen, covering all the components of case assembly 606. In one embodiment, this could be the front panel that covers all the components of case assembly 600 and which also shields and protects all the components within the case assembly 600. In one embodiment, two of such panels can cover both the front and rear sides of the case assembly 600.

Figure 7A:
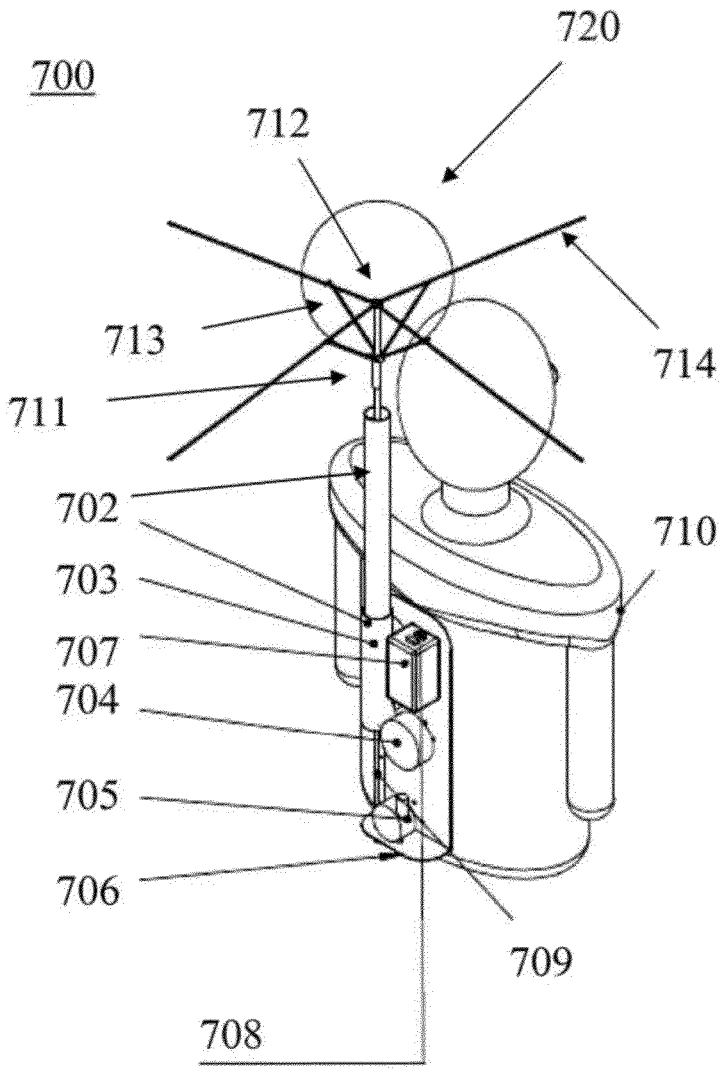
FIG. 7A illustrates an aerial rear view shot of an umbrella backpack mechanism in accordance with an embodiment of the present disclosure.

FIG. 7A illustrates an aerial rear view shot of an umbrella backpack mechanism in accordance with an embodiment of the present disclosure. Umbrella backpack mechanism 700 includes shaft and rim assembly 720 (which in turn includes outer shaft slider 711, which fits into inner tube 702, inner shaft 712, long rib leg 714, short rib leg 713), inner tube 702, outer tube 703, fan 704, raise motor 705, rucksack base 706, battery box 707, buttons and switches 708, drain tube 709 and body 710. Outer shaft slider 711 comes out of inner tube 702 and slidingly engages with inner shaft 712. On outer shaft slider 711 are the short rib leg 713 and long rib leg 714, which connect together with the shaft and rim assembly 720 of the umbrella so that when the legs are fully extended the canopy is fully formed and covering the body 710. The outer shaft slider 711 can also move along the whole length of the inner shaft 712. The short rib leg 713 and the long rib leg 714 join together in supporting the canopy of the umbrella in shaft and rim assembly 720, and when the outer shaft slider 711 is moved upwards, the short rib leg 713 and long rib leg 714 are pushed outwards so as to fully extend and expand out the canopy of the umbrella. When the outer shaft slider 711 is moved downwards, the short rib leg 713 and long rib leg 714 are pushed downwards so as to retract and be placed back within the inner tube 702. The movement of the outer shaft slider 711 may be controlled by, for example, the raise motor 705, or may also be controlled manually by the user, or by some other means that can move the outer shaft slider 711 up and down the inner shaft 712. The body 710 may be a physical human body or it may also be an inanimate structure such as a chair, table, side of a house or similar such object. The inner tube 702 which the outer shaft slider 711 and inner shaft 712 go back into can be made from fabric, cloth, plastic, waterproof material or any such similar substance. Also, in one embodiment, the short rib leg 713 may be longer than the long rib leg 714, in one embodiment, the long rib leg 714 may be shorter than the short rib leg 713, in one embodiment, both the short rib leg 713 and the long rib leg 714 can be the same length, and both the short rib leg 713 and the long rib leg 714 may take on any size, shape or length and are not limited to their lengths or configurations due to their names. The shaft and rim assembly 720 may be covered by a canopy (not shown), for example, which may be made from any material that is usually used for the canopy of an umbrella, such as, for example, cloth, fabric, synthetic material or any such material.

Figure 7B:
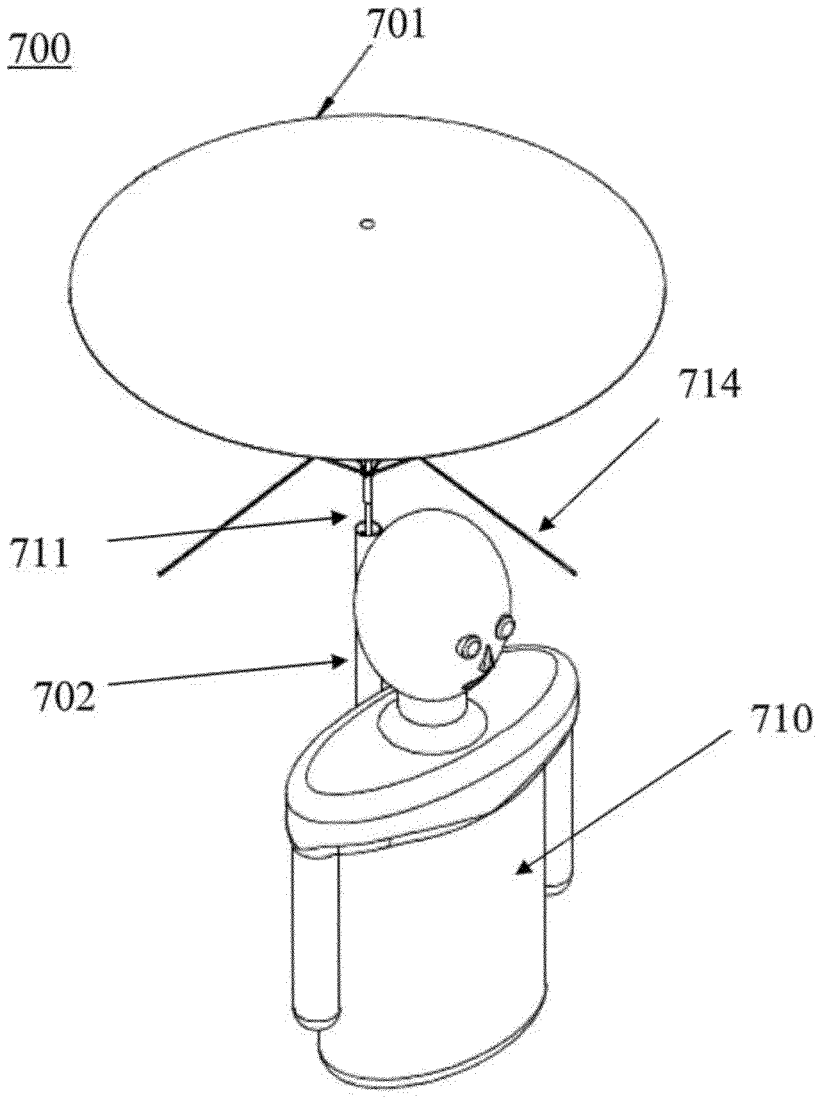
FIG. 7B illustrates an aerial front view shot of an umbrella backpack mechanism in accordance with an embodiment of the present disclosure.
Figure 7C:
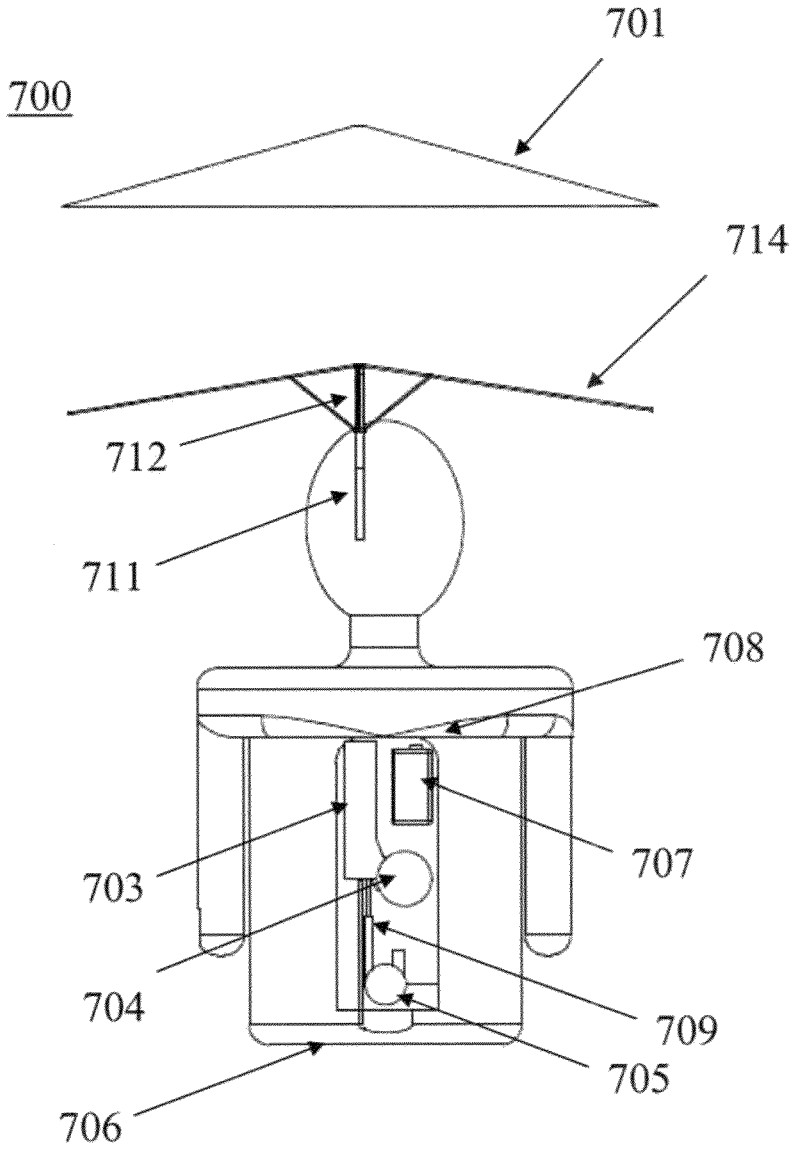
FIG. 7C illustrates a rear view shot of an umbrella backpack mechanism in accordance with an embodiment of the present disclosure.
Figure 7D:
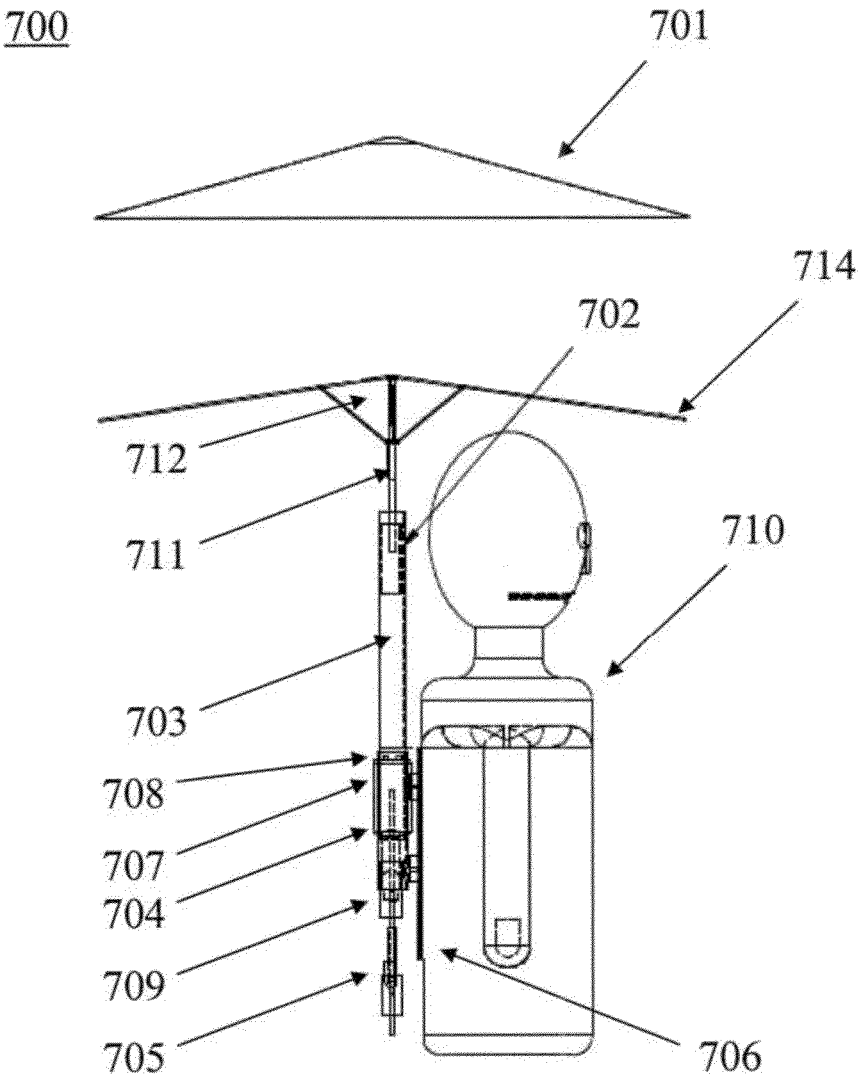
FIG. 7D illustrates a side view shot of an umbrella backpack mechanism in accordance with an embodiment of the present disclosure.
Figure 7E:
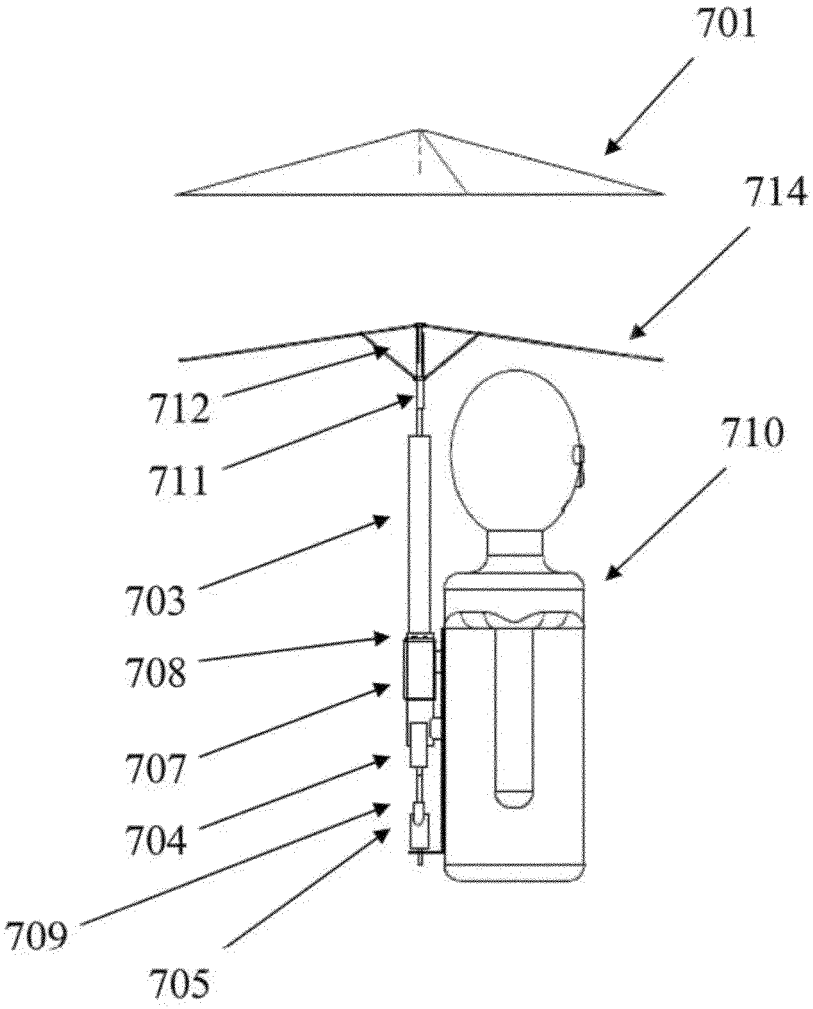
FIG. 7E illustrates another side view shot of an umbrella backpack mechanism in accordance with an embodiment of the present disclosure.
Figure 7F:
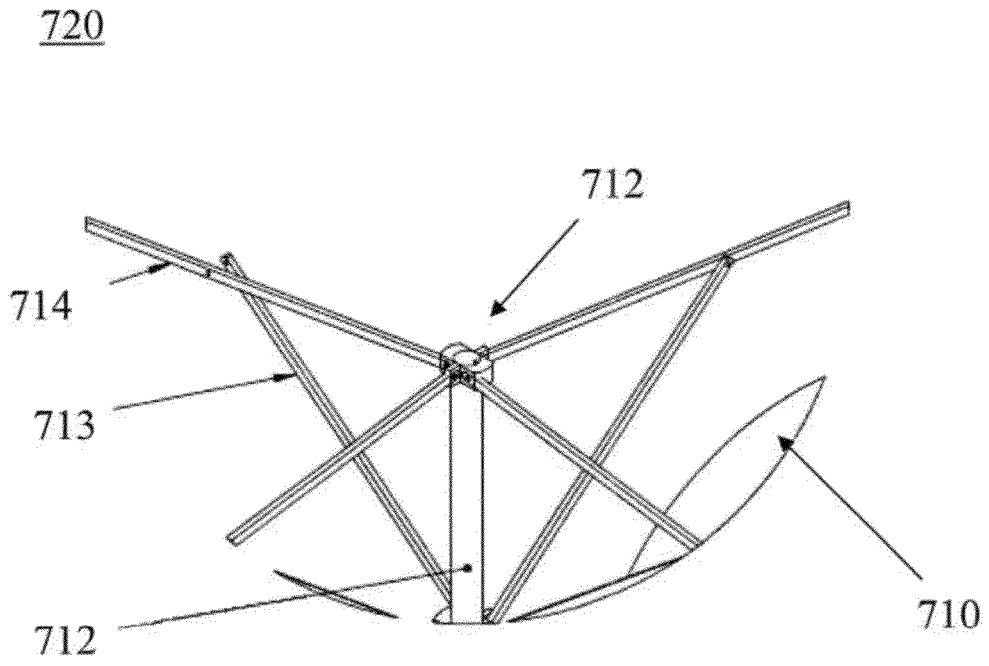
FIG. 7F illustrates a zoomed in view of the shaft and rib assembly of an umbrella backpack mechanism in accordance with an embodiment of the present disclosure.

Inner tube 702 is connected to the shaft and rib assembly 720, as shown in more detail in FIG. 7F (and FIG. 1E). Inner tube 702 also may slidingly fit or engage with outer tube 703. In other words, the radius and circumference of inner tube 702 is smaller than the radius and circumference of outer tube 703 so that inner tube 702 may fit within outer tube 703 and inner tube 702 may also be able to slide up and down within outer tube 703 as well. Outer tube 703 may also house inner tube 702 and the umbrella when the umbrella is fully retracted, and may also lock inner tube 702 into place when inner tube 702 and the umbrella (as well as the umbrella's canopy) are fully extended. A fan 704 may also be part of the umbrella backpack mechanism 700 that may cool down the user or also cool down the mechanics of the umbrella backpack mechanism 700 (such as its raise motor 705 or any lights, circuitry or other components that may get hot). Raise motor 705 controls the raising and lowering of the inner tube 702 connected to the canopy of the umbrella and also controls the contraction as well as expansion of the umbrella canopy. Raise motor 705 may be controlled, for example, by a button or switch that is located on the unit (e.g., such as button and switches 708, or could also be something that is a portable handheld unit or remote conveniently controlled by the user, or conveniently located on a front strap of the backpack, for instance). The raise motor 705 may also be powered by a battery and charger system (such as, for example, the battery box 707), or may be powered by a direct power connection, or another power source such as, for example, a solar powered unit or other similar unit. Rucksack base 706 may be a larger backwards-L shaped structure, where the flat surface of the rucksack base supports components such as, for example, the battery box 707 or the raise motor 705, even though battery box 707 is shown positioned above in the middle, it may also be configured near the bottom of the rucksack base 706. The vertical surface of the rucksack base 706 may be used to align with the back of the body 710 of a user, or there may also be padding between the vertical surface of the rucksack base 706 and the back of the body 710 of the user so that the user is comfortable and that the backpack of the umbrella backpack mechanism 700 has proper support and structure for all the components it houses. Buttons and switches 708 may include buttons or switches to control the fan 704 and/or buttons or switches to control the raising and lowering of the inner tube 702 connected to the shaft and rib assembly 720. Also, additional buttons or switches that control other components not shown in FIG. 7A may also be included within the buttons on buttons and switches 708. Also, buttons and switches 708 may not necessarily be position where it is shown in FIG. 7A; for instance, it may be positioned on the bottom of rucksack base 706. As just another example, buttons and switches 708 may also be on a plug in an extender flying lead that can be in a pocket, belt or hand, or part of a remote or handheld device that can be conveniently pressed, or be conveniently positioned on the front strap of a backpack for easy access by the user, for example. Drain tube 709 is connected to outer tube 703 and also inner tube 702 and may release air or fluids so as to facilitate the movement and operation of the inner tube 702 rising and lowering when controlled by the raise motor 702. The drain tube 709 also works in tandem with the raise motor 705 so as to maximize the efficiency of the raising and lowering of the umbrella and the expansion/retraction of the shaft and rib assembly 720. Drain tube 709 also may drain the water that could be pooling or sitting in the canopy of the umbrella when the canopy attached to the shaft and rib assembly 720 is closed (or during the closing process) to avoid excessive dripping on other surfaces, such as, for example, the user's clothes or the ground or carpet. Finally, body 710 is the body of a user that may use the umbrella backpack mechanism 700. Although FIG. 7A shows the user wearing the umbrella backpack mechanism 700 on the back of the user's body 710, the displacement and position of the umbrella backpack mechanism 700 is not limited to this configuration, and can be worn on the front, the sides, the top or bottom of the user's body 710, and may also be mounted as a unit on any structure or wall such as a chair, table, side of a house, boat, cargo ship, cargo box, stand, and so on. Therefore, body 710 may also include any of these inanimate structures, in addition to a physical human body.

FIG. 7B illustrates an aerial front view shot of an umbrella backpack mechanism in accordance with an embodiment of the present disclosure. The components are the same as discussed above for FIG. 7A. However, there is a new component, canopy 701 which is attached to the shaft and rib assembly 720 and is the component that extends out when various components (such as the long rib leg 714 or the short rib leg 713 extend out completely) in order to completely cover, protect or shield the user 710 from rain or other weather elements. Long rib leg 714 is also shown as being extended out, just as an example of the range of how far the canopy can extend. In one embodiment, long rib leg 714 can also be used as an additional means of support, or additional channels to redirect rain water away from the canopy and the user. The canopy 701 and the front of the body 710 can also be more clearly seen from this view in FIG. 7B. The inner tube 702 may also be seen in the background. Again, the umbrella backpack mechanism may not necessarily be just worn on the back of the body 710, but may also be worn on the front, side, bottom or top of the body 710 as well.

FIG. 7C illustrates a rear view shot of an umbrella backpack mechanism in accordance with an embodiment of the present disclosure. The components are the same as discussed above for FIGS. 7A and 7B. The canopy 701 and the long rib leg 714 attached to the inner shaft 712 are also shown to emphasize the range of how far the canopy 701 can expand. In one embodiment the long rib leg 714 can be used as, or in tandem with, channels to facilitate the clearing of rain water away from the body 710 of the user and the rest of the umbrella backpack mechanism 700. A clearer view of the rucksack base 706 as well as the fan 704, the inner tube 702, the outer tube 703, the raise motor 705 and the battery box 707, as well as the buttons and switches 708, may be seen. Furthermore, even though this is shown as being on the back of body 710, it is not limited to this configuration, and may be positioned on the front, side, top or bottom of the body 710 of a user or structure.

FIG. 7D illustrates a side view shot of an umbrella backpack mechanism in accordance with an embodiment of the present disclosure. The components are the same as discussed above for FIGS. 7A and 7B. The canopy 701 and the long rib leg 714 attached to the inner shaft 712 are also shown to emphasize the range of how far the canopy 701 can expand. In one embodiment the long rib leg 714 can be used as, or in tandem with, channels to facilitate the clearing of rain water away from the body 710 of the user and the rest of the umbrella backpack mechanism 700. A clearer view of the backwards L-shape of rucksack base 706 can be seen, and also the side view of inner tube 702, outer tube 703, fan 704, drain tube 709, and buttons and switches 708 can also be seen as well. The umbrella backpack mechanism 700 also does not need to be positioned on the rear of the user's body 710 but again can be positioned on the top, bottom, front or any other configuration. The view in FIG. 7D also reveals various transparencies of the different components to show where all the different components engage and fit with each other.

FIG. 7E illustrates another side view shot of an umbrella backpack mechanism in accordance with an embodiment of the present disclosure. FIG. 7E is nearly identical to FIG. 7D above, but the components are "filled in" and are not shown in a transparency view, in order to make the viewing of the different components clearer, and to make it easier to distinguish where certain components begin and where other components end. Accordingly, all the components of FIG. 7E were discussed in FIG. 7D and above.

FIG. 7F illustrates a zoomed in view of the shaft and rib assembly of an umbrella backpack mechanism in accordance with an embodiment of the present disclosure. Shaft and rim assembly 720 includes short rib leg 713, long rib leg 714, inner shaft 712, outer shaft slider (not shown), inner tube (not shown), and body 710. The bottom of inner shaft 712 may connect to the outer shaft slider (not shown) or directly to the inner tube (not shown), or to a combination of both. In one embodiment, the outer shaft slider comes out of inner tube and slidingly engages with inner shaft 712. Connected to the inner shaft 712 are the short rib leg 713 and long rib leg 714, which connect together with the shaft and rim assembly 720 of the umbrella so that when the legs are fully extended the canopy 701 is fully formed and covering the body 710. The outer shaft slider can also move along the whole length of the inner shaft 712. The short rib leg 713 and the long rib leg 714 join together in supporting the canopy of the umbrella in shaft and rim assembly 720, and when the outer shaft slider or inner shaft 712 is moved upwards, the short rib leg 713 and long rib leg 714 are pushed outwards so as to fully extend and expand out the canopy of the umbrella. When the outer shaft slider or inner shaft 712 is moved downwards, the short rib leg 713 and long rib leg 714 are pushed downwards so as to retract and be placed back within the inner tube. The movement of the outer shaft slider or inner shaft 712 may be controlled by, for example, the raise motor 705, or may also be controlled manually by the user, or by some other means that can move the outer shaft slider or inner shaft 712 up and down. The body 710 may be a physical human body or it may also be an inanimate structure such as a chair, table, side of a house or similar such object. The inner tube 702 which the outer shaft slider and inner shaft 712 go back into can be made from fabric, cloth, plastic, waterproof material or any such similar substance. Also, in one embodiment, the short rib leg 713 may be longer than the long rib leg 714, in one embodiment, the long rib leg 714 may be shorter than the short rib leg 713, in one embodiment, both the short rib leg 713 and the long rib leg 714 can be the same length, and both the short rib leg 713 and the long rib leg 714 may take on any size, shape or length and are not limited to their lengths or configurations due to their names. The shaft and rim assembly 720 may be covered by a canopy (not shown, but for example canopy 701), for example, which may be made from any material that is usually used for the canopy of an umbrella, such as, for example, cloth, fabric, synthetic material or any such material.

In one embodiment, there can be a number of other components added to the backpack unit of the umbrella backpack mechanism, such as, for example, fans, lights, heater units (for cold temperatures), cooler units (for hot temperatures), entertainment units for watching media or listening to music, GPS units, computers, decorations, aesthetic customizations, scent plug-ins, built-in mobile phones, sports equipment, additional pockets, and additional devices, equipment, features, add-ons that otherwise would enhance the experience of using an umbrella backpack mechanism.

In one embodiment, the contracted umbrella may rest within the inner tube. In one embodiment, the contracted umbrella may rest within the inner tube, which may in turn rest within the outer tube. In one embodiment, the contracted umbrella may rest within the outer tube. In one embodiment, the contracted umbrella may rest within another sleeve or housing structure.

In one embodiment, the backpack umbrella mechanism has more applications that just being used as an attachment to a backpack to be worn on the rear of the human body. The backpack mechanism can be used in other circumstances as well, such as, for example, attaching a backpack unit or unit to a chair, any outdoor setting, any type of boat of any size, a boat chair. Also, the umbrella may be opened so that it is sitting in a tube that could be metal or fabric and operated by electric power. The backpack umbrella mechanism may also be used in any type of work situation where people, cargo, important cargo, Naval corps, sensitive items that need to be protected from the rain, snow, excessive sun or weather need to be covered. Also, in fishing, the backpack umbrella mechanism may be either attached to the body of a person on a boat, on the boat itself somewhere or on a structure on the boat, or on the side of the boat (for instance, a giant umbrella that opens and close automatically and when one is close to you, and something that a user will not usually see). The number of applications for the backpack umbrella mechanism is infinite, and can especially be utilized by many different professions, careers, and those in the Army, Military and Navy. An object like the backpack umbrella mechanism simply does not exist on the market at all currently.

V-Shaped Umbrella Opening

In one embodiment, the umbrella used in the umbrella backpack mechanism may utilize a variety of different design ideas. For instance, in one embodiment, a V opening scheme/structure may be utilized where the umbrella opens in a "V" shape or scheme that has the canopy spread against a shorter length with more bulk and may have slightly more cost to manufacture. In one embodiment, an A type opening scheme/structure may be utilized where the umbrella opens in a "A" shape or scheme, and is the most common and has the canopy spread over a longer length and hence has less bulk and is off-the-shelf with a low cost to manufacture. In one embodiment, a M-shaped umbrella or scheme may be utilized that shapes the umbrella like a M. In one embodiment, a W-shaped umbrella may be used, where the umbrella is shaped like a W (see FIGS. 16-18, below). In one embodiment, a V and A and W and M type opening scheme/structure may be utilized, or a combination of the all or some of those opening types, and this combination may be designed by electronics systems engineering. In one embodiment, the umbrella may be an auto-open type of umbrella or automatically opening umbrella that opens its canvas automatically. In one embodiment, the umbrella may be a W fold type with auto-opening capabilities. In one embodiment, the umbrella may be a M fold type with or without auto-opening capabilities. In one embodiment, a standard opening umbrella could be used, where the umbrella handle may be replaced with a moveable platform which moves up and down inside the storage receptacle that stores the contracted umbrella. In one embodiment, the umbrella may open under a spring operation and close using a wind-in motor. The handle-less design (where the umbrella's handle is replaced with a movable platform) would allow the purchase of slightly modified standard-umbrellas, or umbrellas with no handles attached.

In one embodiment of the V-shaped umbrella mechanism, the umbrella may be placed in an intermediate configuration between an open configuration and a closed configuration (see FIG. 10B, below), such that the canopy is partially extended but is still angled inward toward a shaft assembly. In this intermediate configuration, the umbrella may be used as a water collection mechanism to collect rain water that falls on the umbrella and drains toward the shaft assembly. The water may be collected for storage and future use or simply to protect a surface or object beneath the canopy from exposure to rain, snow, ice, hail, etc. The umbrellas may be arranged in an array in order to protect a large area greater than the surface area of a single umbrella from exposure to rain or other elements. Since the umbrella mechanism is placed in an intermediate configuration with an overall concave shape, rain will collect at the center of the canopy instead of falling off the peripheral edges of the canopy, thus allowing an array of overlapping canopies to completely protect a large area from exposure to moisture. As has been already described herein, the shaft assembly may include a drain tube 109 which drains water, and this drain tube 109 could be connected with a reservoir (not shown) which stores the collected rain water. In this embodiment, the umbrella could be mounted to a structure such as a table, patio or roof to collect rainwater. Depending upon the degree to which the umbrella has been opened, the umbrella may continue to provide protection from the rain while it also collects rainwater, thus providing a dual-purpose use for the umbrella. Additional lock or latching mechanisms may be provided to lock the umbrella in place at an intermediate setting.

In one embodiment, the umbrella mechanism may be handheld. In the handheld umbrella mechanism, a handheld housing would still enclose the components of the umbrella mechanism but be provided with a smaller diameter to make the housing more capable of being held by a user in their hand. In one embodiment, the handheld umbrella may be operated by the aforementioned springs and latches in order to provide a more lightweight, compact design that can be more easily held. The handheld umbrella mechanism may therefore open and close automatically via motor, manually via a latch release and springs, or through a combination of both automatic and manual functions.

The various embodiments of the umbrella mechanisms described herein may be operated by one or more motors connected with batteries, an electrical current from an outside power source, a solar-powered device positioned on the umbrella or connected with the umbrella, or any other type of power-generating source. The umbrella mechanism may also be operated by springs, magnets, air pressure or vacuum pressure (pneumatics) or other movement-generating forces depending on the type of umbrella. Combinations of these various types of actuation may also be provided. The umbrella mechanism may also be manually-operated, such that a user simply extends the shaft assembly into an open configuration and uses a latch or other fixing mechanism to lock the umbrella in the open configuration.

In one embodiment, at least one solar cell may be implemented into a portion of the umbrella to power some portion of the umbrella. The at least one solar cell may be positioned on an upper end of the shaft assembly and wired to a battery and eventually the motor through the shaft. In another embodiment, the at least one solar cell could be implemented into the canopy material through the use of a solar-electric fabric, such as that made by ShadePlex, LLC (Ann Arbor, Mich. 48103). The at least one solar cell may be arranged into a solar panel to provide for more power to operate one or more devices on the umbrella. The power generated by the at least one solar cell may be used to open and close the umbrella mechanism, or may be used to power one or more features of the umbrella, such as a lighting mechanism for the interior or exterior of the umbrella, a heating mechanism (such as a heated handle), a music player or a display device.

The umbrella mechanisms described herein may be attached with a fixed object such as a chair, table, balcony, wall, floor, etc. or be attached with an article of clothing such as a jacket, shirt or pants to provide a user with protection from the elements without needing to hold the umbrella in hand. Since the V-shaped umbrella mechanism opens up and out, the umbrella mechanism may be attached with a beach chair, such that a user of the beach chair can easily open the umbrella mechanism while sitting in the beach chair without the umbrella canopy hitting the user during the opening process. The umbrella mechanism may be attached with the chair by a bracket or mounted into a base of the chair, although the number of ways which the umbrella can be attached with the chair is not limited to those described herein.

In one embodiment, the umbrella may be supported by a base which holds the umbrella upright without needing support from a person or other object. The base allows the umbrella to be freestanding on the ground, such that a large umbrella could be placed at a pool area or beach where it would not need to be anchored to a table, chair, patio, or held by a user. The base may be weighted to anchor the umbrella in place and prevent the umbrella mechanism from falling over during strong winds or rain. The base may also have a large opening in which the housing and a portion of the shaft assembly may be contained. The shaft assembly may have a plurality of telescoping cylindrical shafts which extend and contract in series so as to provide a small footprint for the overall shaft assembly to be stored within the housing when the umbrella mechanism is in the closed position. The shaft assembly may then extend vertically for a significant distance before the rib assembly extends outward to open the canopy. Depending on the diameter of the canopy and the length of the shaft assembly, all or a substantial portion of the umbrella mechanism may be stored in the base when the umbrella is in a closed position, so as to provide a compact, unobtrusive storage mechanism.

Figure 8:
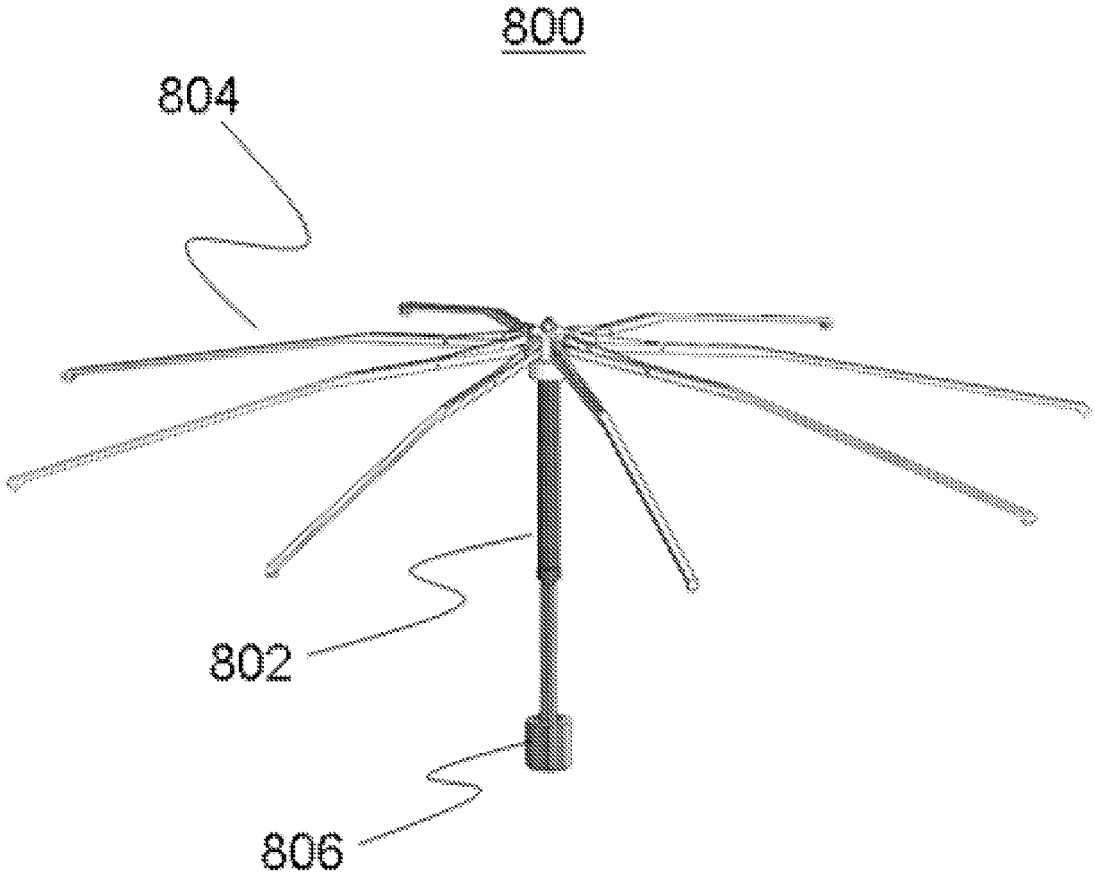
FIG. 8 illustrates one embodiment of a V-shaped handheld umbrella, depicting a shaft assembly, rib assembly and a handheld housing which accepts a lower portion of the shaft assembly.

FIG. 8 illustrates one embodiment of a V-shaped handheld umbrella 800, depicting a shaft assembly 802, rib assembly 804 and a handheld housing 806 which accepts a lower portion of the shaft assembly 802. The handheld housing 806 is cylindrical and small enough in diameter that a user can grasp substantially all of the housing 806 around their hand to securely hold the umbrella. In this embodiment in FIG. 8, the rib assembly 804 is in an opened position.

Figure 9:
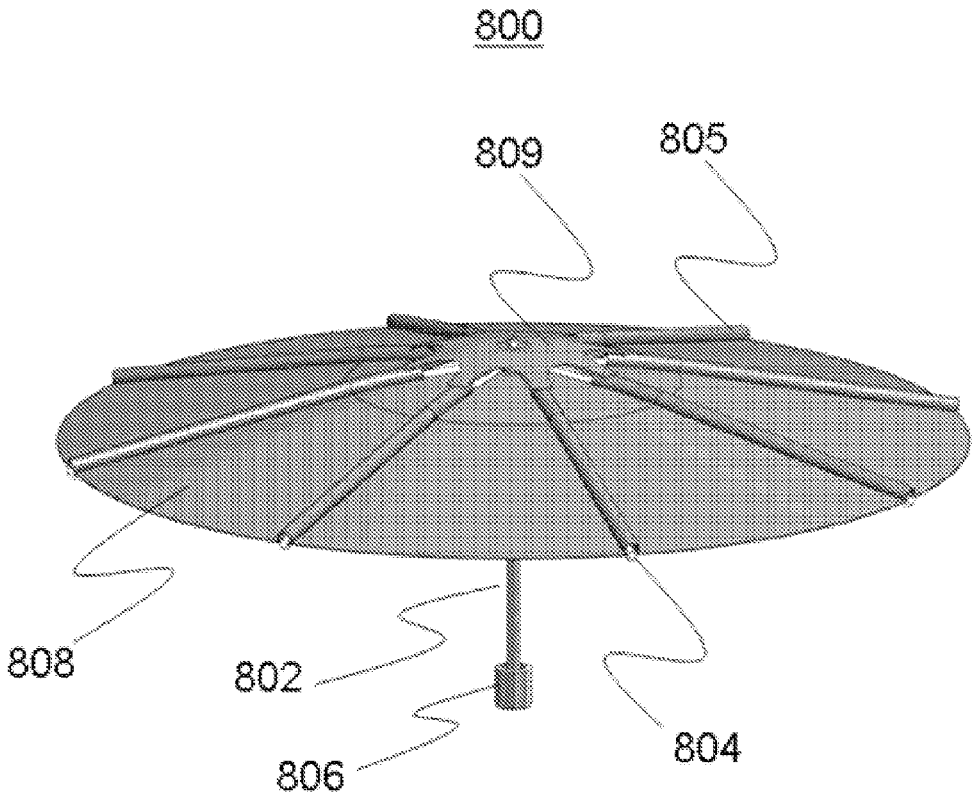
FIG. 9 illustrates the V-shaped handheld umbrella with the canopy attached with the rib assembly in an opened configuration.

FIG. 9 illustrates the handheld umbrella with the canopy 808 attached with the rib assembly 802 in an opened configuration. It should be noted that the canopy 808 is positioned underneath the rib assembly 804 (i.e. against a bottom surface 821—see FIG. 10D) such that in the opened configuration, the rib assembly 804 would be exposed to the outside environment instead of covered by the canopy 808. The position of the canopy 808 on this lower or underneath side of the rib assembly 804 is due to the V-shaped opening method described above and further described and illustrated below. The V-shaped opening method provides for the canopy 808 to be positioned on the underneath side of the rib assembly 804 rather than above or on top of the rib assembly 804, as is seen on known umbrella designs. The canopy 808 is positioned on the underneath side to provide for sufficient room to store the canopy 808 when the umbrella 800 is in a closed position, as is illustrated below with regard to FIG. 10. Since the rib assembly 804 would otherwise be exposed to the environment in the opened configuration, rib sleeves 805 may be provided to protect the rib assembly 804 from exposure to the outside environment. The rib sleeves 805 may be hollow cylindrical sections of material attached with the canopy 808 which cover a substantial length of the rib assembly 804. The rib sleeves 805 also provide the structural support to the canopy 808 from the rib assembly 804, as the rib sleeves 805 are fixedly attached with the canopy 808. In one embodiment, the rib sleeves 805 are made from the same material as the canopy 808, such as a nylon fabric, and can therefore be sewn or bonded together through one or more manufacturing techniques.

FIG. 9 also illustrates a protective central canopy 809 which is designed to cover a central portion of the rib assembly 804 in the opened configuration. Due to the direction in which the rib assembly 804 extends and opens during an opening and closing operation, the rib sleeves 805 do not cover the entire length of the rib assembly 804. Specifically, central rib supports 811 connecting each rib 813 with an upper rib support structure 815 prevent extension of the rib sleeves 805 over a central portion of each rib 813 near the shaft assembly 802 (see FIGS. 10A-10D, below). Therefore, the central canopy 809 may be attached with a central portion of the rib sleeves 805 or the canopy 808 and cover a central portion of the rib assembly 804 and the shaft assembly 802, including the central rib supports 811 and the upper rib support structure 815. The central canopy 809 also prevents rain from entering through the central portion of the umbrella 800. The central canopy 809 may be made from the same material as the canopy 808 and rib sleeves 805, and can therefore be sewn or bonded together through one or more manufacturing techniques.

Figure 10A:
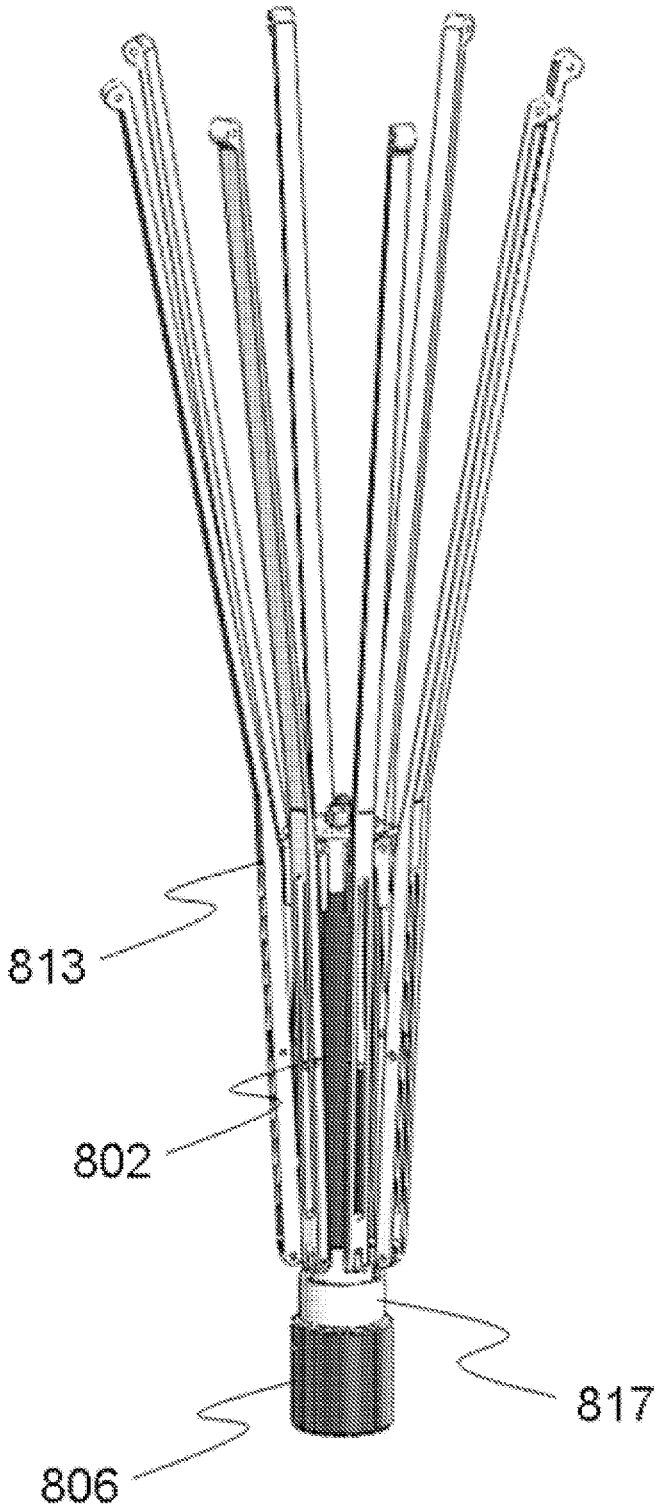
FIGS. 10A-10D illustrate one embodiment of a V-shaped umbrella as the umbrella moves from a closed configuration to an opened configuration, depicting the movement of the rib assembly and shaft assembly.

FIGS. 10A-10D illustrate one embodiment of the umbrella 800 with a V-shaped opening mechanism. The canopy 808 is not illustrated here in for clarity in understanding the opening mechanism of the rib assembly 804. The V-shaped opening mechanism is named based upon the "V" shape of the rib assembly 804 in the closed position, as shown in FIG. 10A. In the V shape, the angle between one rib and a corresponding rib on an opposite side of the shaft assembly 802 is less than approximately 180 degrees, and may be less than 90 degrees. As illustrated in FIG. 10A, the angle between one or more ribs may be a substantially acute angle less than 45 degrees. The V-shaped opening mechanism provides a less obtrusive opening process by first moving the canopy 808 up in a vertical direction along the shaft assembly 802 before expanding the canopy 808 outward radially from the shaft assembly 802. Therefore, a user of the umbrella 800 can open the umbrella in close proximity to their body without being hit by the canopy 808 as it expands, unlike a traditional A-shaped opening mechanism which immediately opens outward radially from the shaft assembly at the same time as it extends vertically. FIGS. 5A and 5B demonstrate one embodiment of the benefit of a V-shape umbrella where the umbrella can open when located in a backpack in close proximity to the user without hitting the user. The benefits of the V-shaped opening extend beyond the use of the umbrella in a backpack, however, and may be useful generally as a handheld umbrella or as a mounted umbrella for a table, patio or balcony. The specific mechanics of the V-shaped opening mechanism are described in further detail herein.

FIG. 10A illustrates one embodiment of the umbrella 800 in a closed position, depicting the rib assembly 804 in a closed position such that the ribs 813 are folded vertically against the shaft assembly 802. The ribs 813 are attached to a lower rib support structure 817 which is itself slidingly attached with the shaft assembly 802.

Figure 10B:
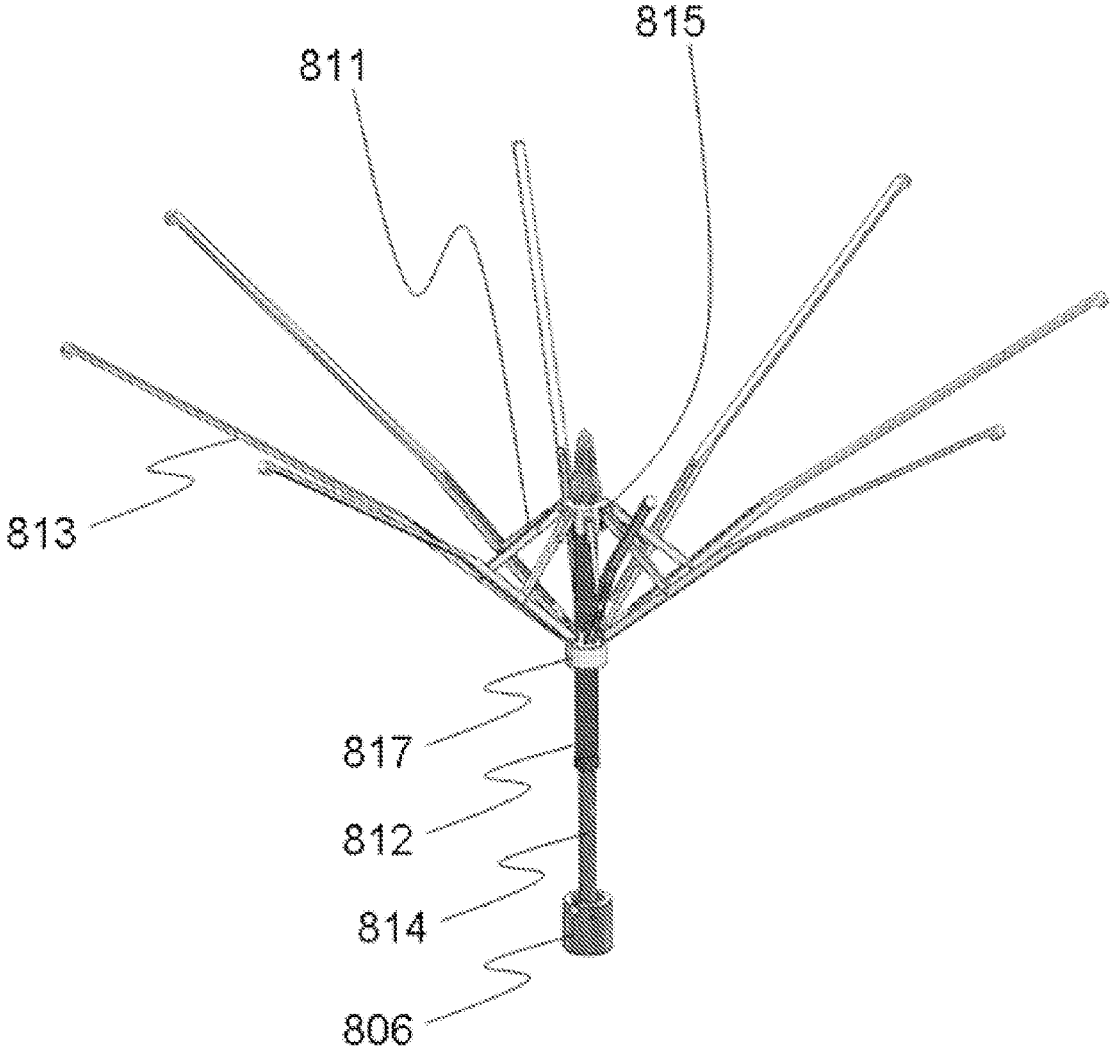

FIG. 10B illustrates the V-shaped umbrella 800 in a partially-opened configuration, as would be seen during the process of opening (or closing) the umbrella 800. The lower rib support structure 817 slides vertically along an outer shaft 812 while the outer shaft 812 also slides vertically along the inner shaft 814, thus providing for significant vertical movement of the rib assembly 804 as it expands radially, preventing it from expanding into a user who may be holding the umbrella while opening or closing it in close proximity to their body. The rib assembly is designed to be supported by the upper rib support structure 815 which is connected with central rib supports 811 that hingedly attach with each rib

813. As the ribs 813 are extended outward radially from the shaft assembly 802, the central rib supports 811 also extend outward radially from the upper rib support structure 815 to provide structural support to the extended ribs 813.

Figure 10C:
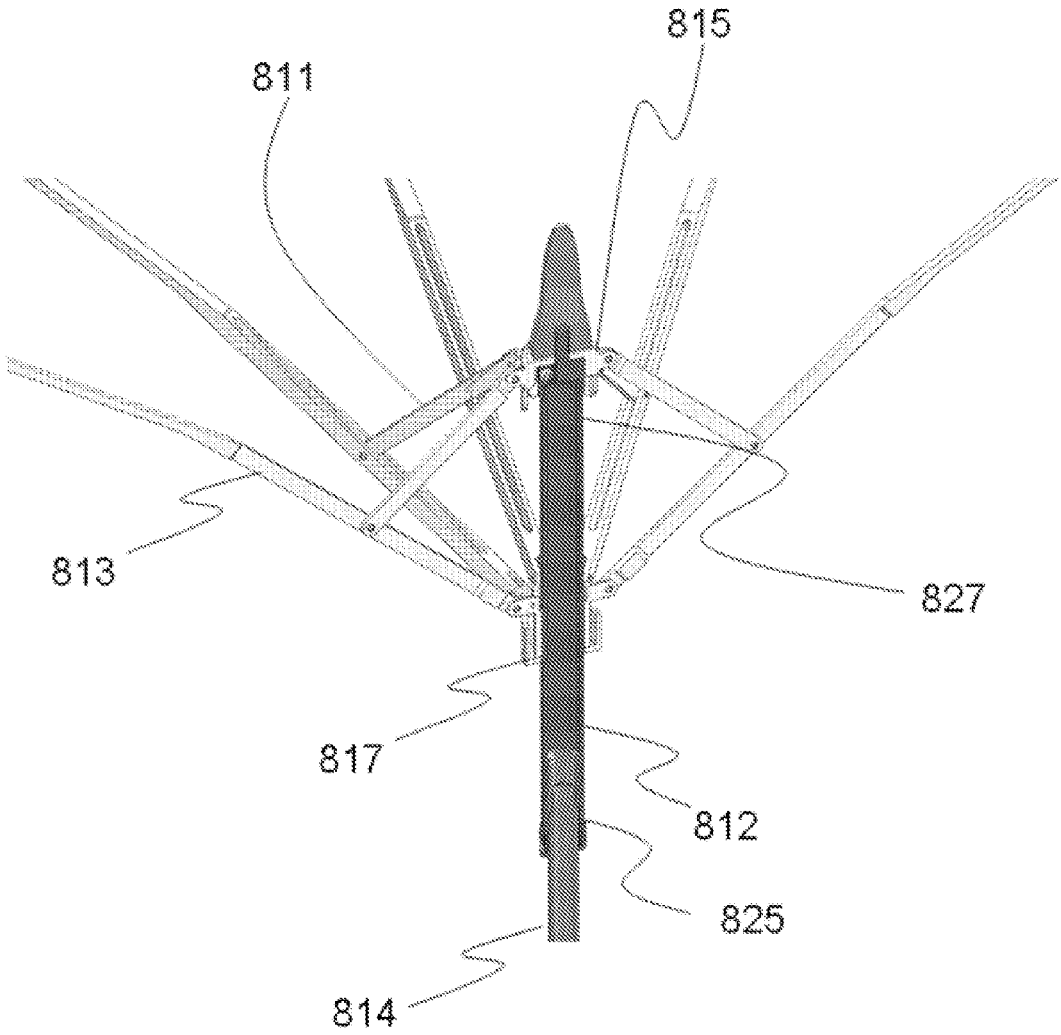

FIG. 10C is a close-up cross-section illustration of the V-shaped umbrella 800 in the partially-opened configuration of FIG. 10B, showing further detail of the structure of the ribs 813 being hingedly connected with the central rib supports 811. As the V-shaped umbrella 800 opens, both the ribs 813 and the central rib supports 811 extend outwardly toward a perpendicular angle with the outer shaft 812 and inner shaft 814. The lower rib support structure 817 begins sliding along the outer shaft from a lower end 825 of the outer shaft to an upper end 827 of the outer shaft where the upper rib support structure 815 is anchored. The ribs 813 are hingedly connected with the lower rib support structure 817, while the central rib supports 811 are hingedly connected with the upper rib support structure 815, allowing both the ribs 813 and central rib supports 811 to swing outward and away from the outer shaft 812 during the opening process.

Figure 10D:
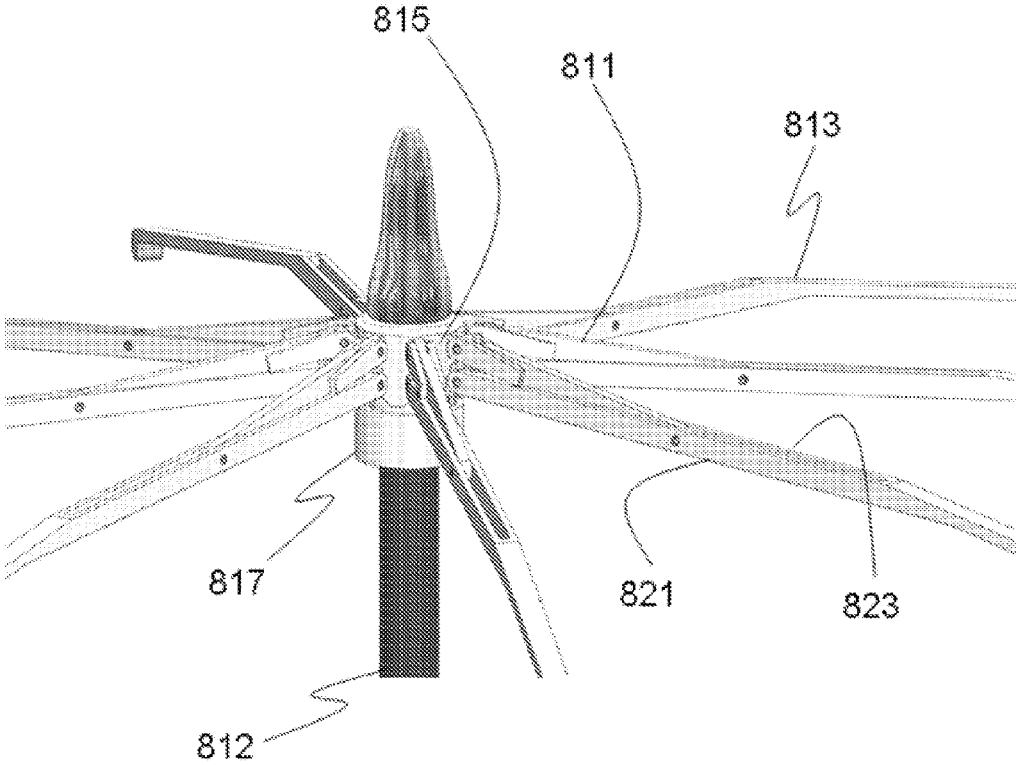

FIG. 10D illustrates a close-up illustration of the V-shaped umbrella 800 in the opened configuration, with the ribs 813 and central rib supports 811 fully extended outward in a horizontal orientation, perpendicular to the outer shaft 812. The lower rib support structure 817 has now slid upwardly along the outer shaft 812 until it is adjacent to the upper rib support structure 815. As described above, the canopy 808 is positioned against a bottom portion 821 of the ribs 813, while a top portion 823 is left exposed to the outside environment. The lower rib support structure 817 and upper rib support structure 815 may be configured to interlock with each other or slidingly fit together to increase the strength of the umbrella 800 in the opened configuration. Furthermore, a separate latch mechanism may be included on the outer shaft 812 in order to latch the lower rib support structure in place at this upper position, thereby keeping the umbrella in the opened configuration until the latch is released. In one embodiment, the spring mechanism which opens the umbrella may provide sufficient force to maintain the lower rib support structure 817 at the upper position without requiring a latch mechanism.

Figure 11:
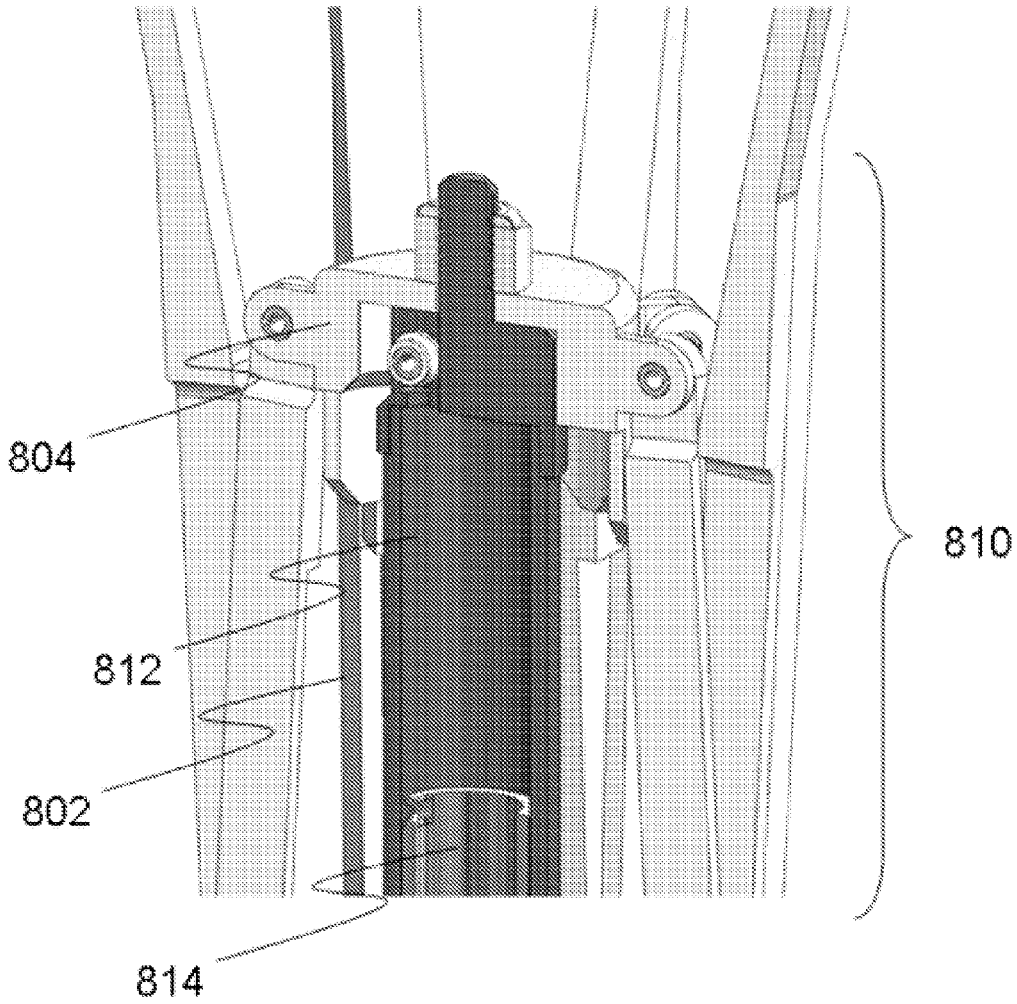
FIG. 11 illustrates an upper portion of the shaft assembly of the handheld umbrella in a closed position, depicting an outer shaft and an inner shaft, with the rib assembly connected with the outer shaft.

FIG. 11 is a detailed view of an upper portion 810 of the shaft assembly 802 of the handheld umbrella 800 in a closed position, depicting an outer shaft 812 and an inner shaft 814, with the rib assembly 804 connected with the outer shaft 812.

Figure 12:
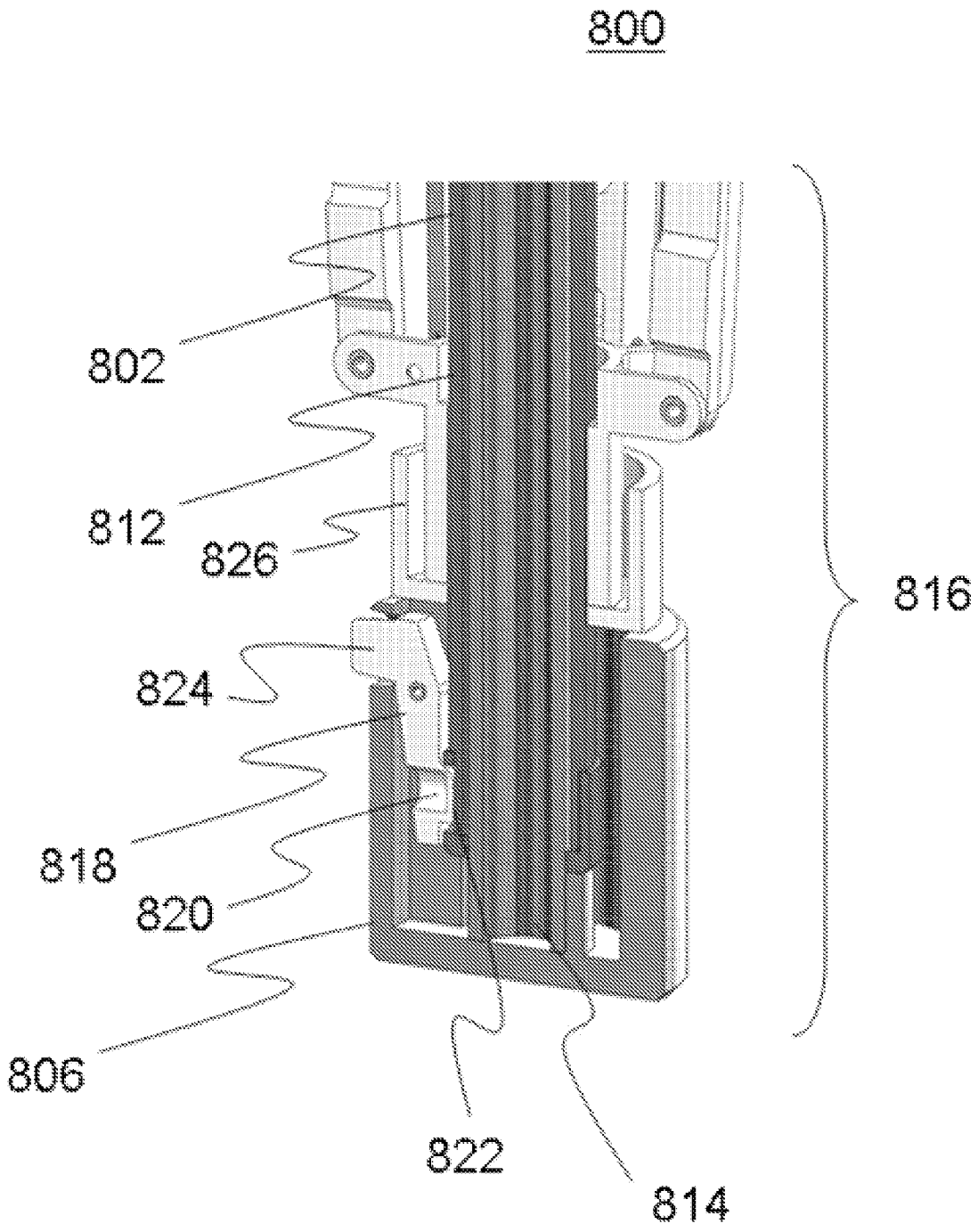
FIG. 12 illustrates a lower portion of the shaft assembly of the handheld umbrella in a closed position, depicting the handheld housing surrounding the lower portion and specifically surrounding portions of the outer shaft and inner shaft.

FIG. 12 is a detailed view of a lower portion 816 of the shaft assembly 802 of the handheld umbrella in a closed position, depicting the handheld housing 806 surrounding the lower portion 816 and specifically surrounding portions of the outer shaft 812 and inner shaft 814. A latch mechanism 818 is positioned in the handheld housing to detachably attach with the outer shaft 812. The latch mechanism 818 specifically contains a latching protrusion 820 which engages with a latching notch 822 in the outer shaft 812. The latching mechanism 818 also includes an outer protrusion 824 which protrudes through the handheld housing 806. The outer protrusion 824 and latching protrusion 820 are positioned on opposite ends of the latching mechanism 818, with a central section of the latching mechanism hingedly connected with a portion of the handheld housing. When a user depresses the outer protrusion 824, it hingedly moves the latching protrusion 820 from the latching notch 822 in the outer shaft 812 and releases the outer shaft 812. The outer shaft 812 then slides upward away from the handheld housing 806. FIG. 12 also depicts a base section 826 of the rib assembly 804 which is attached with the lower portion of the outer shaft 812. When the outer shaft 812 is released, the base section 826 of the rib assembly also slides upward away from the handheld housing, causing the rib assembly 804 to extend into the opened position shown in FIG. 8.

Figure 13:
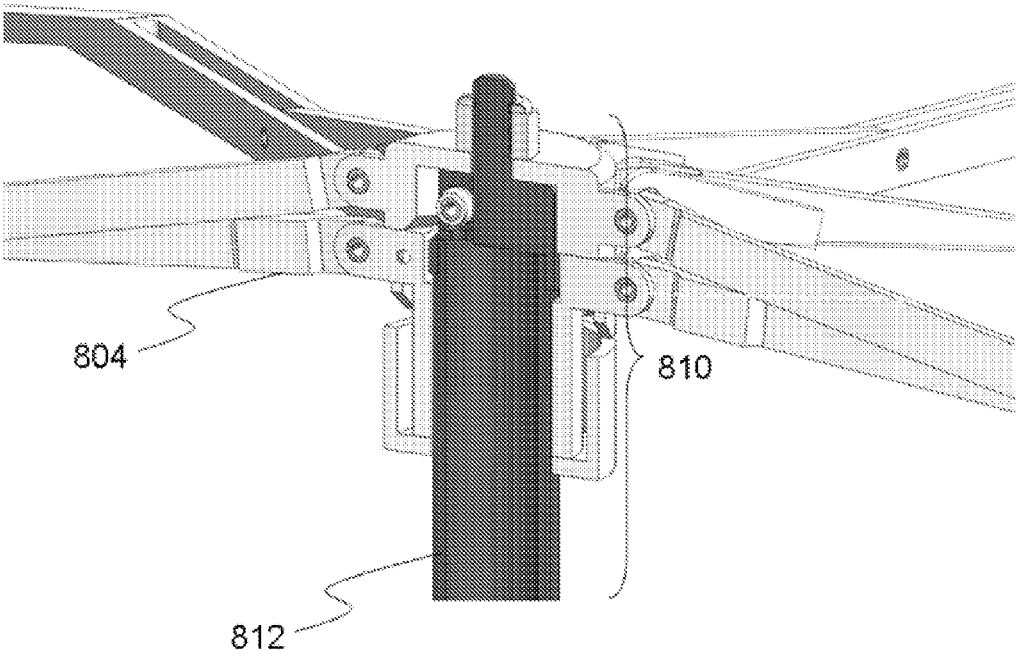
FIG. 13 illustrates a detailed view of the upper portion of the shaft assembly with the rib assembly in the opened position.
Figure 14:
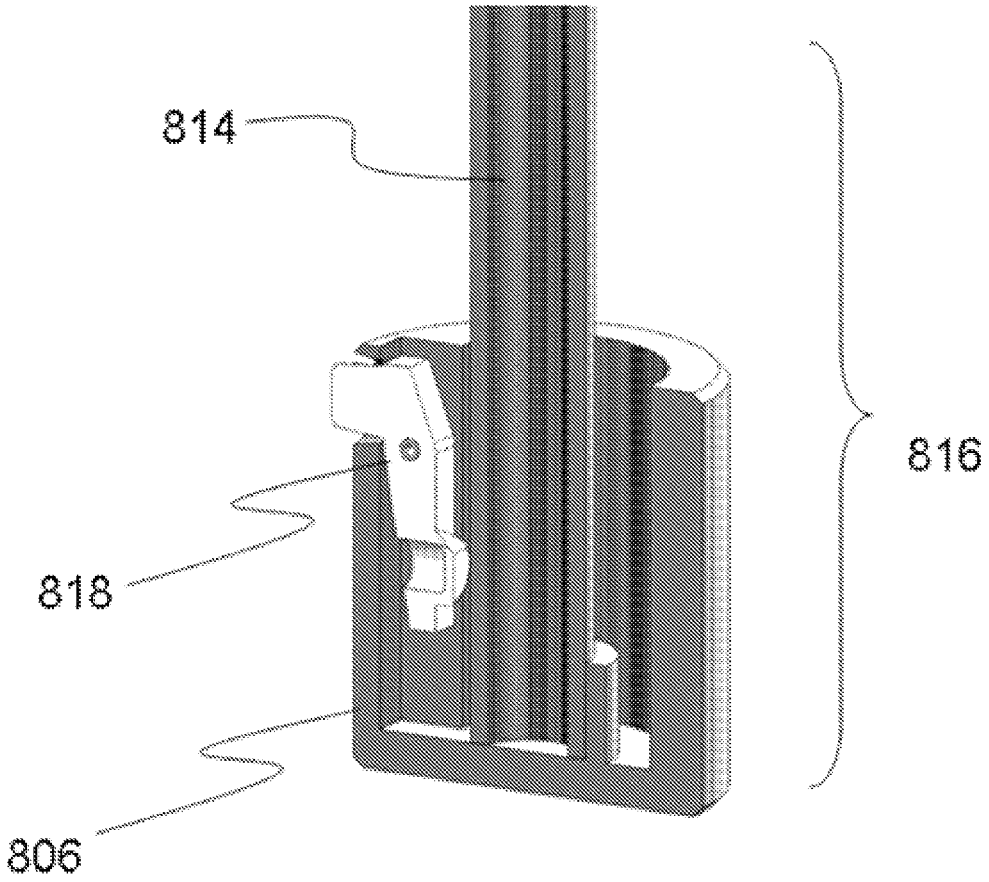
FIG. 14 illustrates the handheld housing and inner shaft after the outer shaft has been released from the latching mechanism and extended upward.

FIG. 13 illustrates a detailed view of the upper portion 810 of the shaft assembly with the rib assembly 804 in the opened position. The outer shaft 812 has extended upward and away from the inner shaft 814 such that the inner shaft 814 is no longer visible. FIG. 14 illustrates the handheld housing 806 and inner shaft 814 after the outer shaft 812 has been released from the latching mechanism 818 and extended upward. The outer shaft 812 is no longer visible.

Figure 15:
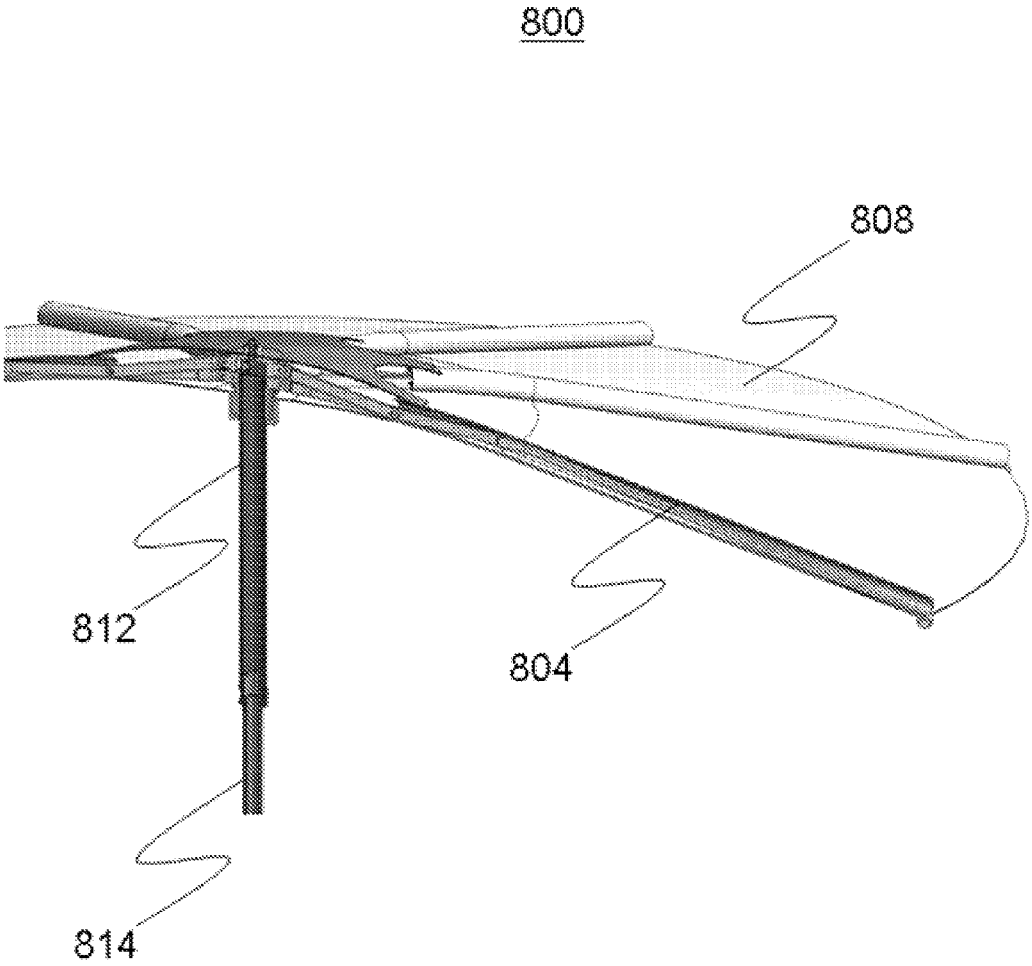
FIG. 15 illustrates an embodiment of the handheld umbrella mechanism in the opened configuration with the canopy attached with the rib assembly.

FIG. 15 illustrates an embodiment of the handheld umbrella mechanism in the opened configuration with the canopy 808 attached with the rib assembly 804. The outer shaft 812 has fully extended upward so that it is only partially covering the inner shaft 814.

W-Shaped Umbrella Opening

Figure 16:
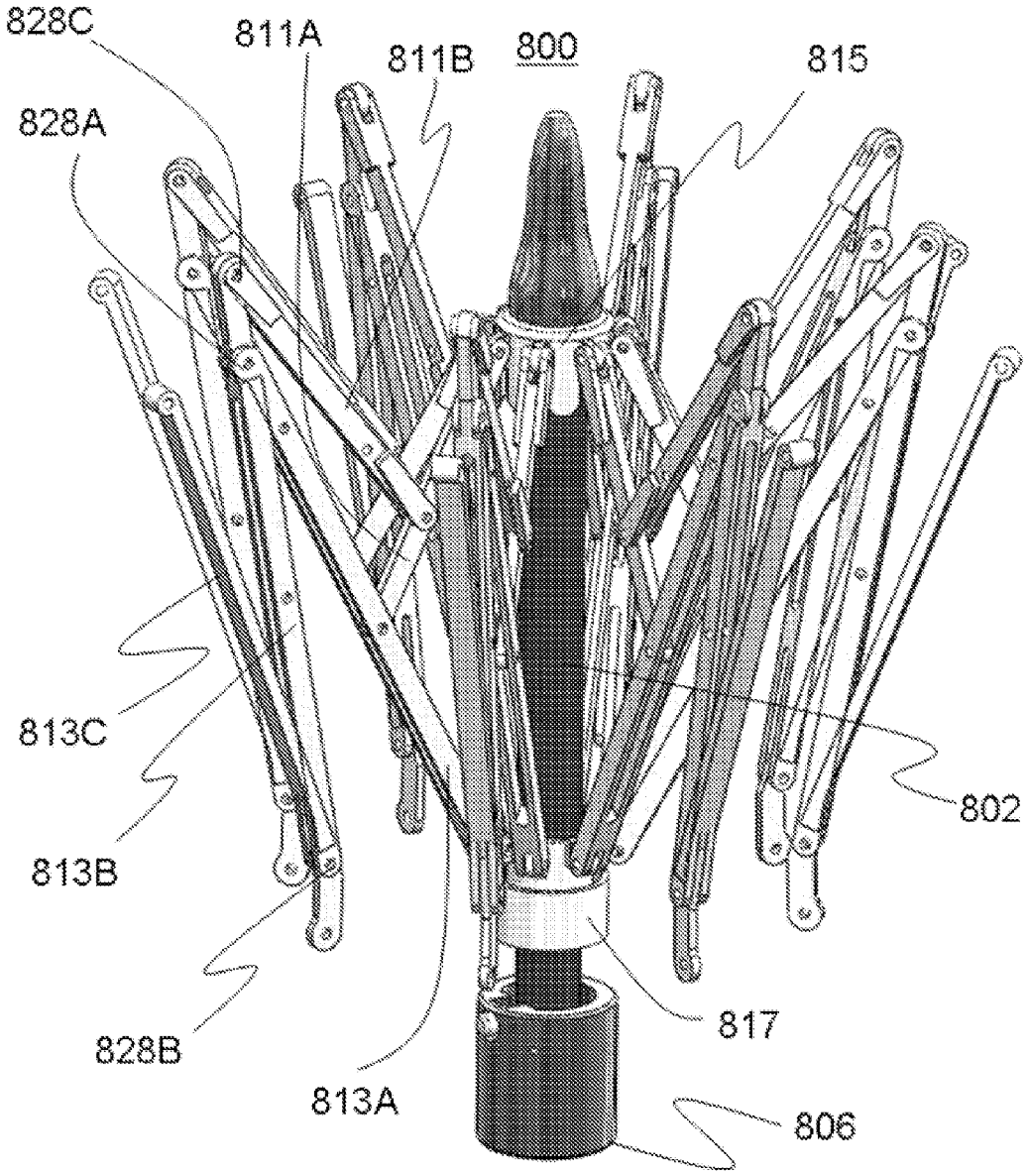
FIG. 16 illustrates one embodiment of, the umbrella be configured in a "W" shape when in the closed position.

In one embodiment, the umbrella may be configured in a "W" shape when in the closed position, as illustrated in FIG. 16. The W-shaped umbrella configuration includes a plurality of ribs 813 which are divided into three separate rib sections—a interior rib section 813A, a middle rib section 813B and an outer rib section 813C. The ribs 813 are connected by hinges 828 to allow the ribs to fold into the closed position and extend into the open position. A first hinge 828A connects the interior rib section 813A with the middle rib section 813B, while a second hinge section 828B connects the middle rib section 813B with the outer rib section 813C. In this embodiment, the interior rib section 813A is supported by an interior central rib support 811A, while the middle rib section 813B is supported by a middle central rib support 811B. In this embodiment, the interior central rib support 811A is connected with the upper rib support structure 815 on a first end and the interior rib section 813A on an opposing second end. The middle central support rib 811B is connected with a middle portion of the interior central support rib 811A on a first end and the middle rib section 813B on a second end. The connection between the middle central support rib 811B and the middle rib section 813B may be a third hinge portion 828C similar to the first hinge section 828A and located immediately adjacent to the first hinge section 828A. The connections between all of the rib sections and central rib supports may be hinged connections, as illustrated in FIG. 16, although they are not all described herein for clarity.

Figure 17:
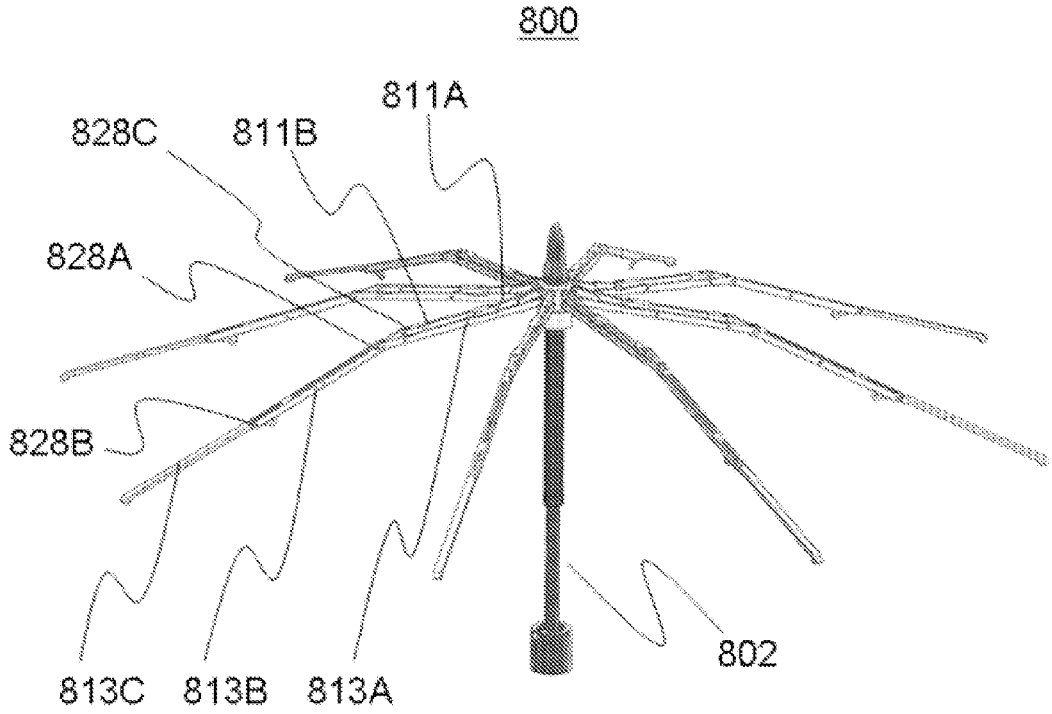
FIG. 17 illustrates one embodiment of the W-shaped umbrella in an open configuration.

FIG. 17 illustrates one embodiment of the W-shaped umbrella in an open configuration, such that three separate rib sections 813A, 813B and 813C have been unfolded during the opening process. The middle rib section 813B has been extended outward from the shaft assembly at the first hinge point 828A, while the outer rib section 813C has been extended outward from the shaft assembly at the second hinge point 828B. The middle central support rib 811B and interior central support rib 811A are also now fully extended to a point that they run parallel to the interior rib section 813A, while the middle central rib support 811B still connects with the middle rib section 813B at the third hinge section 828C.

When the ribs 813 are in the closed position, the angle between each of the rib sections (measured at the hinges 828) is an acute angle, such that the ribs 813 may be folded up in a compact configuration close to the shaft assembly 802. When the ribs 813 are extended along with the central support ribs 811, the angles between the rib sections at the hinge points become significantly larger and may be substantially 180 degrees. In the closed position, each hinge 828 creates an acute angle between the sections of the rib on either side of the hinge. The ribs may be extended into a substantially lateral position in an open position such that each hinge provides a substantially 180 degree angle between the sections of the rib on either side of the hinge. The use of the W-shaped umbrella provides for a smaller area in which the rib assembly can be folded when the umbrella is in the closed position, while still allowing for a large canopy area when the umbrella is in the open position.

Figure 18:
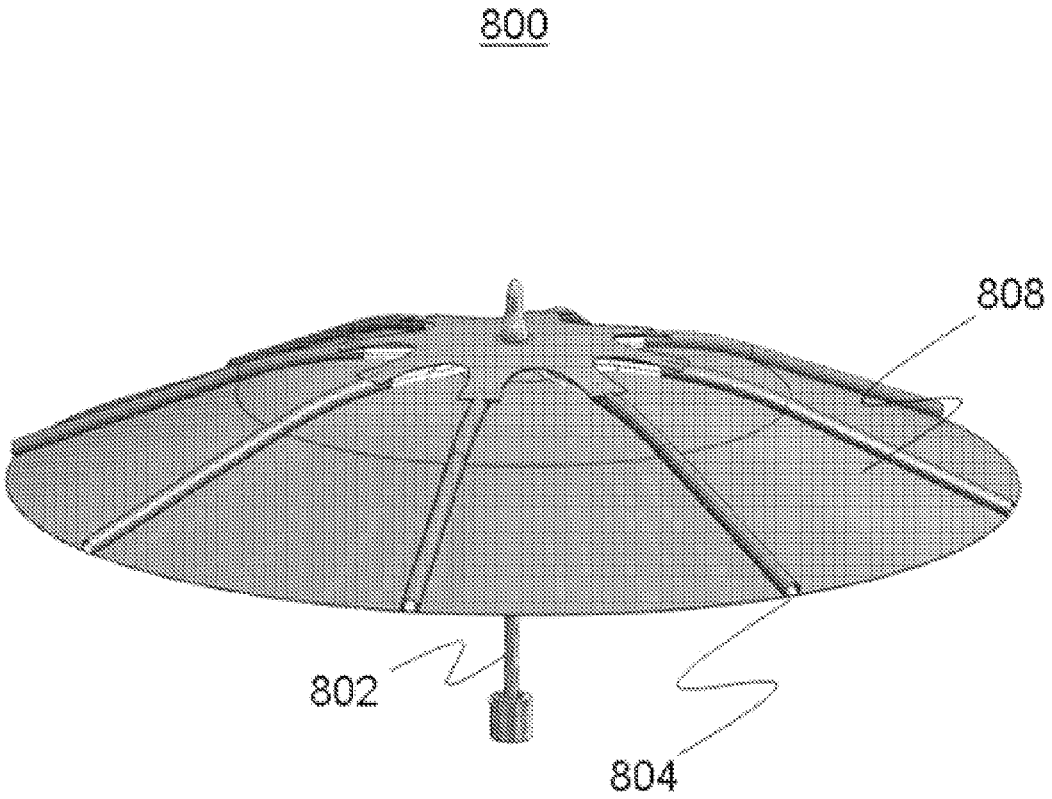
FIG. 18 illustrates the W-shaped umbrella in the opened configuration with the canopy in place.

FIG. 18 illustrates the W-shaped umbrella in the opened configuration with the canopy 808 in place, including the rib assembly 804 in the fully extended position such that the canopy 808 is fully extended away from and over the shaft assembly 802. The canopy of the W-shaped umbrella may be slightly more concave than the V-shaped umbrella simply due to the length of the overall rib assembly and the numerous hinge connections.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter, which is broadly contemplated by the present invention. It is further understood that the scope of the present invention fully encompasses other embodiments that may become obvious to those skilled in the art.

What is claimed is:

1. An umbrella mechanism, comprising:

a outer shaft which slidably attaches with an inner shaft;

a plurality of ribs foldably attached with the outer shaft, wherein the plurality of ribs cannot be folded and extend in an upward direction from the outer shaft at an angle slightly less than parallel to the outer shaft, such that the ribs are configured into a substantially "V" shape when the umbrella mechanism is in a closed configuration;

a foldable canopy supported by the plurality of ribs;

wherein the outer shaft is configured to slide upwardly along the inner shaft and unfold the plurality of ribs in the upward direction substantially parallel to the outer shaft to open the canopy and place the umbrella mechanism is an opened configuration; and a case assembly which substantially surrounds the umbrella mechanism, wherein the case assembly includes a support base, the umbrella mechanism is attached to the support base and is maintained in an upright position, the umbrella mechanism substantially enclosed by the support base in a closed configuration, wherein the case assembly includes a top plate which provides an opening for the umbrella mechanism to extend in the upward direction when moving from a closed position to an open position adapted to be adjacent to a person such that case assembly prevents the umbrella mechanism from coming in contact with the person, and wherein the case assembly is enclosed within a backpack unit which is configured to be attached to a back of the person.

2. The umbrella mechanism of claim 1, wherein the plurality of ribs is connected with the outer shaft at a lower rib support structure on a lower end of the outer shaft, and wherein the lower rib support structure slidingly attaches with the outer shaft in order to slide upwardly along the outer shaft when the umbrella mechanism is moved into the opened configuration.

3. The umbrella mechanism of claim 2, wherein the plurality of ribs is connected with a plurality of central rib supports, the central rib supports being connected with an upper rib support structure on an upper end of the outer shaft.

4. The umbrella mechanism of claim 1, wherein the canopy is attached with a lower end side of the plurality of ribs.

5. The umbrella mechanism of claim 4, wherein each rib in the plurality of ribs is substantially covered by a rib sleeve which extends along a substantial length of each rib.

6. The umbrella mechanism of claim 5, wherein the canopy is attached with the rib sleeves instead of the plurality of ribs, such that the rib sleeves support the canopy via their covering of the ribs.

7. The umbrella mechanism of claim 1, further comprising a central canopy which covers a central portion of the plurality of ribs when the umbrella is in an opened configuration.

8. The umbrella mechanism of claim 1, further comprising a power unit with a motor which slides the outer shaft up and down the inner shaft to move the umbrella mechanism from a closed configuration to an open configuration.

9. The umbrella mechanism of claim 1, further comprising a handheld housing attached with the inner shaft which is configured to be grasped by a human hand.

10. An umbrella mechanism, comprising:

a outer shaft which slidably attaches with an inner shaft;

a plurality of ribs foldably attached with the outer shaft, wherein the plurality of ribs are divided into three sections connected by hinges when the umbrella mechanism is in a closed configuration, wherein the hinges connect the three sections of ribs at acute angles;

a foldable canopy supported by the plurality of ribs;

wherein the outer shaft is configured to slide upwardly along the inner shaft and unfold the plurality of ribs in the upward direction substantially parallel to the outer shaft to open the canopy and place the umbrella mechanism is an opened configuration; and a case assembly which substantially surrounds the umbrella mechanism, wherein the case assembly includes a support base, the umbrella mechanism is attached to the support base and is maintained in an upright position, the umbrella mechanism substantially enclosed by the support base in a closed configuration, wherein the case assembly includes a top plate which provides an opening for the umbrella mechanism to extend in the upward direction when moving from a closed position to an open position adapted to be adjacent to a person such that case assembly prevents the umbrella mechanism from coming in contact with the person, and wherein the case assembly is enclosed within a backpack unit which is configured to be attached to a back of the person.

* * * * *